US007967345B2

(12) United States Patent
Davies

(10) Patent No.: US 7,967,345 B2
(45) Date of Patent: Jun. 28, 2011

(54) ACTUATOR FOR A SCREEN LATCH FOR ENGAGING SILL AND HEADER TRACKS

(75) Inventor: John Robert Davies, Vaughan (CA)

(73) Assignee: 420820 Ontario Limited, Woodbridge, Ontario (CA)

( * ) Notice: Subject to any disclaimer, the term of this patent is extended or adjusted under 35 U.S.C. 154(b) by 546 days.

(21) Appl. No.: 11/448,851

(22) Filed: Jun. 8, 2006

(65) Prior Publication Data

US 2007/0284893 A1 Dec. 13, 2007

(51) Int. Cl.
*E05C 1/06* (2006.01)
*E05B 3/00* (2006.01)

(52) U.S. Cl. ..... 292/37; 292/336.3; 292/DIG. 46

(58) Field of Classification Search ..... 292/32, 292/33, 37, 39, 41, 42, 137, 138, 140, 145, 292/146, 336.3, 150, 163, 169, 172, 174, 292/175, DIG. 46; 49/449; 24/71.1, 129 B, 24/130

See application file for complete search history.

(56) References Cited

U.S. PATENT DOCUMENTS

| | | | | | |
|---|---|---|---|---|---|
| 3,897,163 | A | * | 7/1975 | Holmes | 24/130 |
| 4,248,401 | A | * | 2/1981 | Mittleman | 251/7 |
| 4,341,043 | A | * | 7/1982 | Yamamoto et al. | 49/449 |
| 4,362,034 | A | * | 12/1982 | Amgar | 70/108 |
| 4,393,549 | A | * | 7/1983 | Leonardo | 24/115 A |
| 4,616,864 | A | * | 10/1986 | Douglas | 292/336.3 |
| 4,639,021 | A | * | 1/1987 | Hope | 292/7 |
| 5,382,060 | A | * | 1/1995 | O'Toole et al. | 292/46 |
| 5,524,941 | A | * | 6/1996 | Fleming | 292/34 |
| 5,975,592 | A | * | 11/1999 | Lin | 292/37 |
| 6,003,583 | A | * | 12/1999 | Lacoste et al. | 160/122 |
| 6,082,432 | A | * | 7/2000 | Kissinger | 160/290.1 |

FOREIGN PATENT DOCUMENTS

CA 2086132 6/1994

* cited by examiner

*Primary Examiner* — Carlos Lugo
*Assistant Examiner* — Alyson M Merlino
(74) *Attorney, Agent, or Firm* — Neil H. Hughes; Ivor M. Hughes; Marcelo K. Sarkis

(57) ABSTRACT

An actuator for a latch assembly comprising a cam member including cam surfaces to engage detents to, operate said latch assembly, the resulting motion of the detents to operate a release member for a header latching portion and simultaneously to operate a release member for a sill latching portion, or alternatively to operate release members for jamb latching portions.

17 Claims, 37 Drawing Sheets

ACTUATOR FOR A SCREEN LATCH FOR ENGAGING SILL AND HEADER TRACKS

FIELD OF THE INVENTION

This invention finds particular application for latches of screen assemblies and particularly for a roll screen assembly.

BACKGROUND OF THE INVENTION

Roll screen assemblies are well known in the art. The assignee of this invention, c.o.b. as Preferred Engineering Limited, has several patents issued in relation to various embodiments of roll screen products. Other roll screen products are discussed in those particular issued patents, the details of which patents are incorporated by reference in this application with respect to typical roll screen assemblies and further the prior art discussed therein.

The problem being addressed with respect to the present application is the weakness of typical center locking devices for roll screen assemblies as best seen in relation to FIGS. 10 and 10A. By providing a lock L1 located on the end of the roll out screen and the jamb of a patio door assembly locking the screen at that location creates a predetermined amount of slack in the screen adjacent the high and low ends of the screen as illustrated. However, by providing a latch release bolt proximate the header and sill as shown as 30*a* and 30*b* in FIG. 10A, the slack in the screen disappears and the forces on entire screen are more uniformly distributed. Further the bowing on the roll tube and the handle is minimized. As discussed the slack created in the screen cloth by latching typically at a center point at L1 results in the screen cloth coming out the track with continual cycling of for example a patio screen.

The typical screen assembly mounted on a tube R accumulates around said tube loaded by a spring and mounted on brackets as shown. However, the strength of the tube spring will engage through the point L1 and will therefore create effectively a triangular stretch in the screen cloth as the tube bows in typically approximately 2 mm.

However, by providing a locking portion 30*a* and 30*b* as will be described herein after in the sill and the header or alternatively the jambs for the track within which the screen cloth rides, the entire screen cloth will be stretched by the strength of the tube spring and this will result in the motion of the screen to and from its roll out position within the track without as many problems occurring.

Aside from the prior art of Preferred Engineering, the details of which were incorporated by reference into this application with respect to roll out screen assemblies, one particular centre locking device for a window assembly of Preferred Engineering is found in the art, namely CA 2,086,132 a centre lock as best seen therein in relation to FIG. 32 and 33 for a window assembly. However, such an assembly would not be appropriate for use with a roll screen.

Applicant is also aware of U.S. Pat. No. 4,639,021 to Hope for use with a door as best seen therein in relation to FIG. 1. However, this mechanism is complicated and involves a lot of hardware and meant for use with a door.

Nowhere within the prior art to applicant's knowledge is their found a simple latch mechanism for use with a screen assembly and preferably a roll screen assembly which provides for the engagement of either cut outs in the track or blocks in the track to latch the screen assembly at a fully paid out position in the header and sill or alternatively the jamb tracks.

It is therefore a primary object of the invention to provide a simple latch assembly engageable with sill and header or jamb track parts for a screen assembly.

It is a further object of the invention to provide such an assembly which is simple and light weight but obviates the complications of the previously known center lock devices in prior art constructions.

It is yet a further object of the invention to provide an actuator for a latch assembly which includes cam surfaces to engage detents to operate said latch assembly and preferably to operate a detent engaged with an operator for the header or jamb latching portion and a detent for an operator for engaging the sill or jamb latching portion.

Further and other objects of the invention will become apparent to one skilled in the art when considering the following summary of the invention and the more detailed description of the preferred embodiments illustrated herein.

SUMMARY OF THE INVENTION

According to a primary aspect of the invention there is provided an actuator for a latch assembly comprising a cam member including cam surfaces to engage detents to, operate said latch assembly, the resulting motion of the detents to operate a release member for a header latching portion and simultaneously to operate a release member for a sill latching portion, or alternatively to operate release members for jamb latching portions.

According to another aspect of the invention there is provided an actuator for a latch assembly comprising a camming member having two ends and having disposed proximate each end a grip, and having disposed between said grips a cut out, and having disposed about the material adjacent said cut out, cam surfaces, said cam surfaces for engaging at least one detent, of at least one operator for operating release bolts, the detent being disposed at one end of the operator and having disposed proximate the other end of the operator release bolt engaging parts, said release bolt also including operator engaging parts for engaging said operator, the release bolt traveling in a frame having a hollow therein to carry each operator, said release bolt being engageable with a closure frame at the end thereof remote said operator and for movement between a latched position and an unlatched position when the camming member is moved in a direction generally normal to the extension of said frame, the camming member being held in position by a retainer bushing disposed in a slot in the frame, said bushing also including cut out for receiving the detents of said operators to allow for controlled movement thereof, which in turn provides for the movement of the release bolts to and from the closure frame.

Preferably the cut out in the cam member is generally diamond shaped and preferably the operator includes a pin. In one embodiment the release bolt includes a rack for engaging said operator and the operator includes a rack for engaging said release bolt.

In a preferred the latch assembly further comprises a handle frame for retaining said camming member, operator, and release bolt. Preferably the latch assembly is embodied in a roll out screen assembly.

According to yet another aspect of the invention there is provided an actuator for a latch assembly for a roll out screen having a handle frame disposed at the free end thereof, said actuator comprising a camming member extending generally perpendicular to said frame and having two ends and having disposed proximate each end a grip accessible by a user and causing motion of the camming member laterally away from the handle frame, and having disposed between said grips a cut out being generally diamond shaped, and having disposed about the material adjacent said cut out cam surfaces for engaging a pin provided with at least one operator for operating release bolts for said latch assembly, the pin being disposed at one end of the operator and having disposed proximate the other end of the operator a rack for engaging the release bolt, said release bolt also including a rack for engaging the rack of said operator, the release bolt traveling in the handle frame at the free end of the roll out screen and said handle frame also having a hollow therein to carry each operator and release bolt and also to retain said camming member, said release bolt being engageable, with a track of a closure assembly for the latch assembly, at the end thereof remote said operator and for movement between a latched position wherein the release bolt engages the track and an unlatched position wherein the release bolt disengages the track, wherein the screen can be moved to and from the latched position when the camming member is moved in a direction normal to the extension of said handle frame, the camming member being held in position by a retainer bushing disposed in a slot in the handle frame, said bushing also including a cut out for receiving the pin of said operators to allow for controlled movement thereof, which in turn provides for the movement of the release bolts with respect to the track when the grips of the camming member are engaged by a user.

Preferably the actuator for a latch assembly may be embodied in a closure assembly selected from patio doors, entry doors, windows, and French doors. The actuator for a latch assembly may further comprise a roll out screen extending from one frame member of the closure assembly and a roll out blind extending from the opposite member of the closure assembly.

When the actuator for a latch assembly is embodied in French doors there will be provided a roll screen and latch assembly for each door. The handle frame for each screen for the French doors butts up to one another using a male and female edge for opposed handle frames.

When the actuator for a latch assembly is embodied in a window assembly only one grip is provided with the cam member which further comprises a triangular cutout with cam surfaces, since outside access is unnecessary.

Preferably the latch assembly further comprising header and sill latching portions disposed in each track. In one embodiment the latching portions may further comprise cutouts in the header and sill tracks. In another embodiment the header and sill latching portions further comprise latching blocks installed in closure assembly tracks and having a tapered top terminating in a cutout to receive the header and sill latching portions retained from movement in said cutout until the actuator is operated to retract the header and sill latching portions from said cutout.

In yet another embodiment when the actuator for a latch assembly is embodied in French doors it may further comprise two latching blocks positioned back to back proximate the position where the screen members butt together to prevent over-extension of the screen members beyond the desired butting position.

In yet another embodiment of the latch assembly the handle frame further comprises a preferably telescopic glide disposed at each end to guide the motion of the roll out screen to and from the position of the latching blocks in a tapered channel disposed on the side of each glide thereby capturing laterally extending flanges of said track so as to guide the handle frame therein while allowing for compensation for manufacturing tolerances accommodated by the amount of the taper of the channel. Preferably said glide is retained in position at the end of the handle frame by a pin, which is positioned during assembly in a pin receiving area formed with said glide with said pin passing through said pin receiving area.

In a preferred embodiment of the invention the assembly further comprises springs to bias the operators to engage with the release bolts.

DETAILED DESCRIPTION OF THE PREFERRED EMBODIMENT

Figure 9:
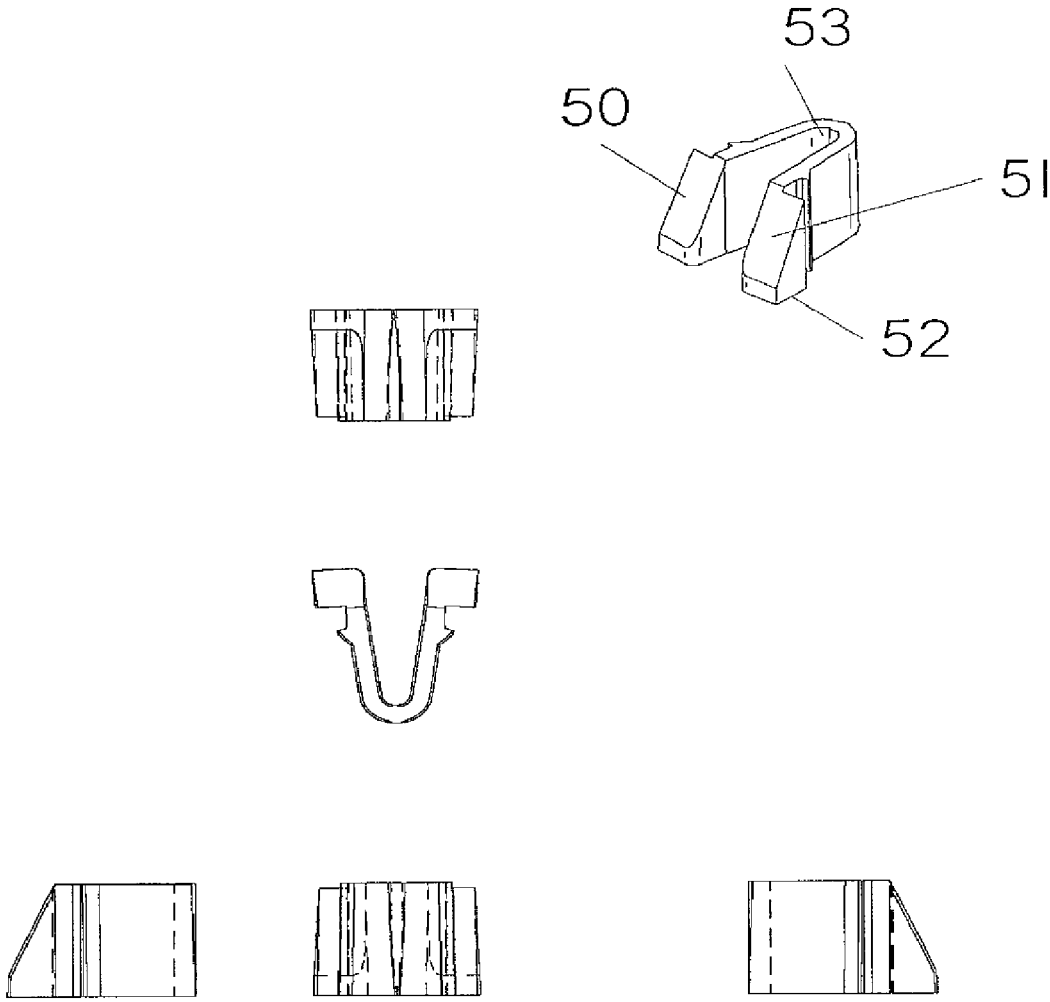
FIG. 9, 9A, 9B and 9C include various views and specifically perspective views of the blocks 50, 60 and 70 located within the track T as best seen in FIG. 11 and FIGS. 9D, 9E, 9F and 9G illustrated in preferred embodiments of the invention.
Figure 9A:
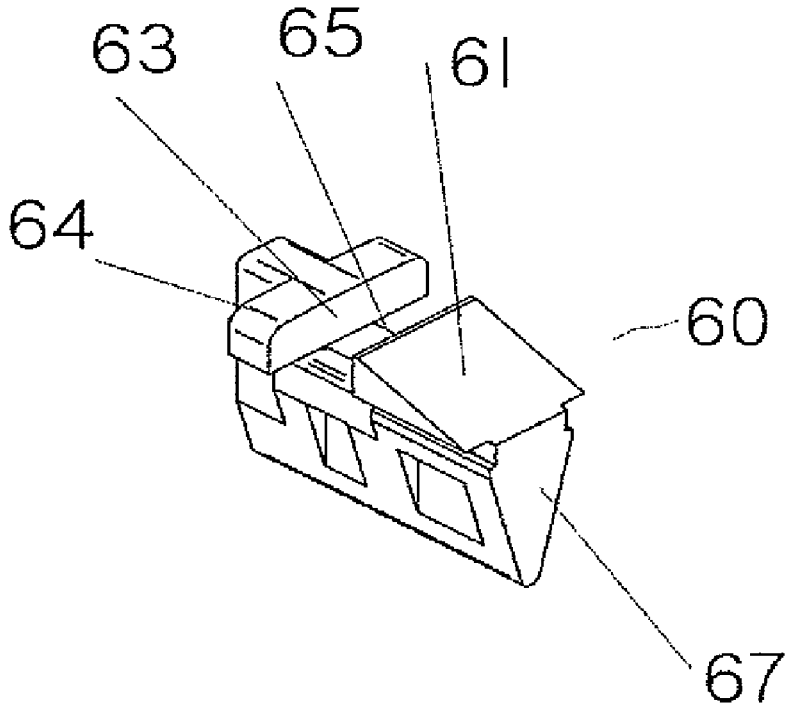
Figure 9A:
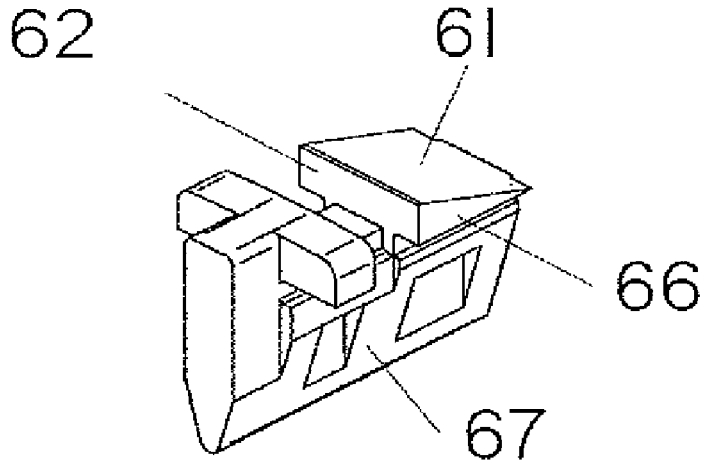
Figure 9B:
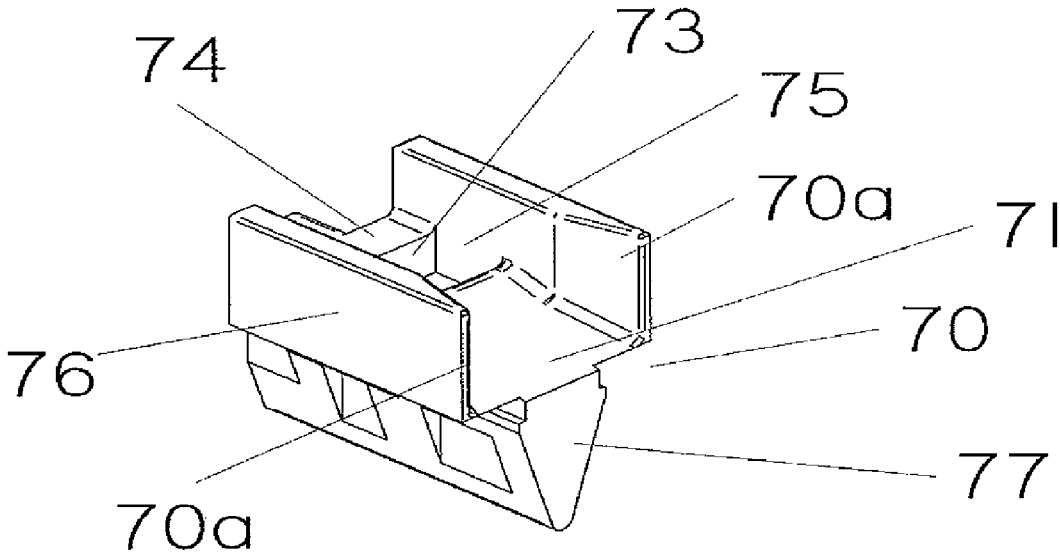
Figure 9C:
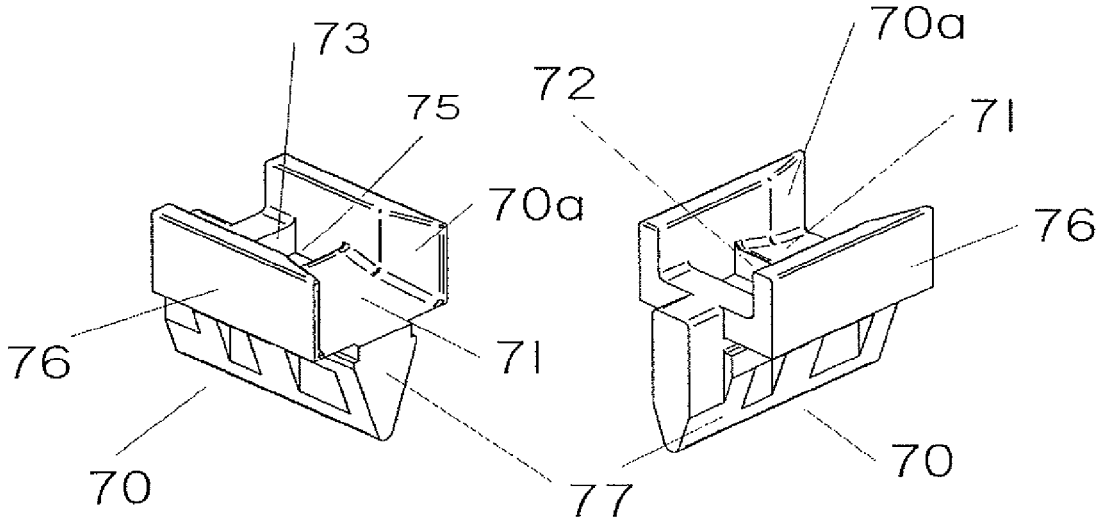
Figure 9D:
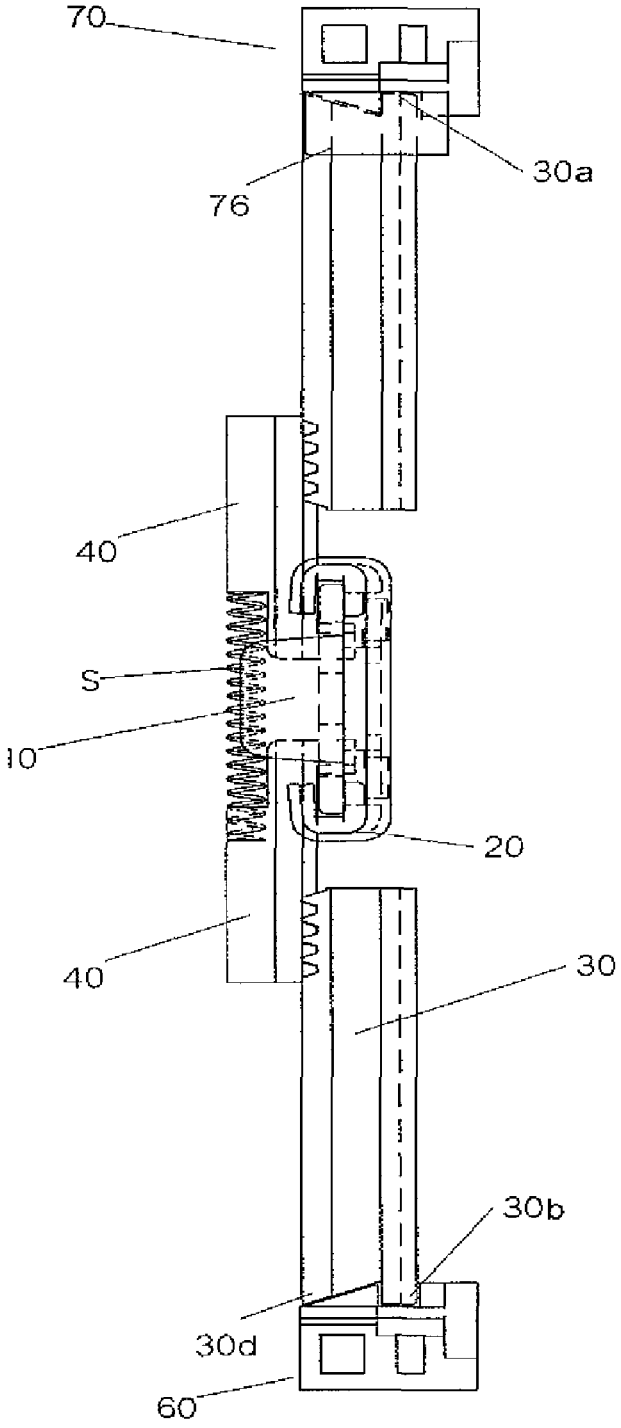
FIGS. 9D, 9E, 9F and 9G are perspective and schematic views of the operating parts of the latch assembly of FIG. 1.
Figure 9E:
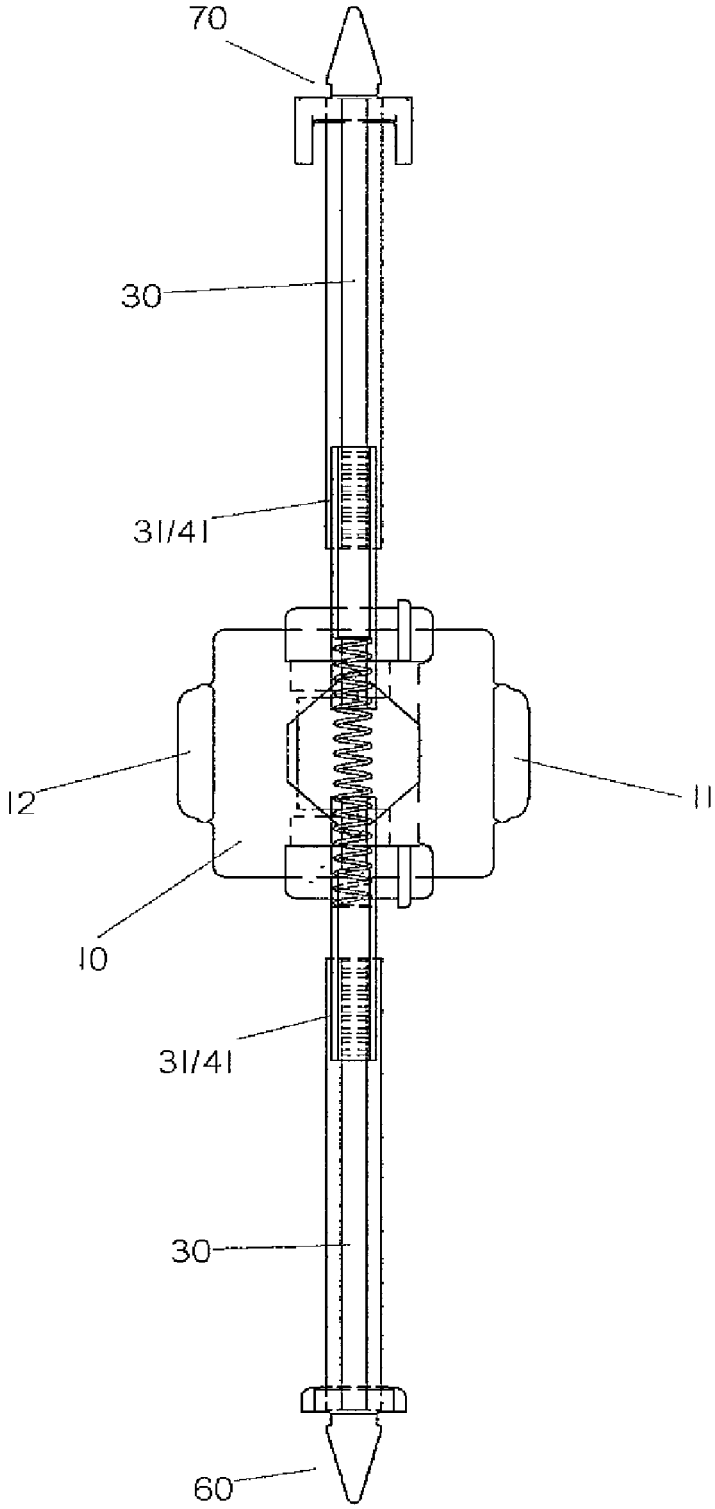
Figure 9F:
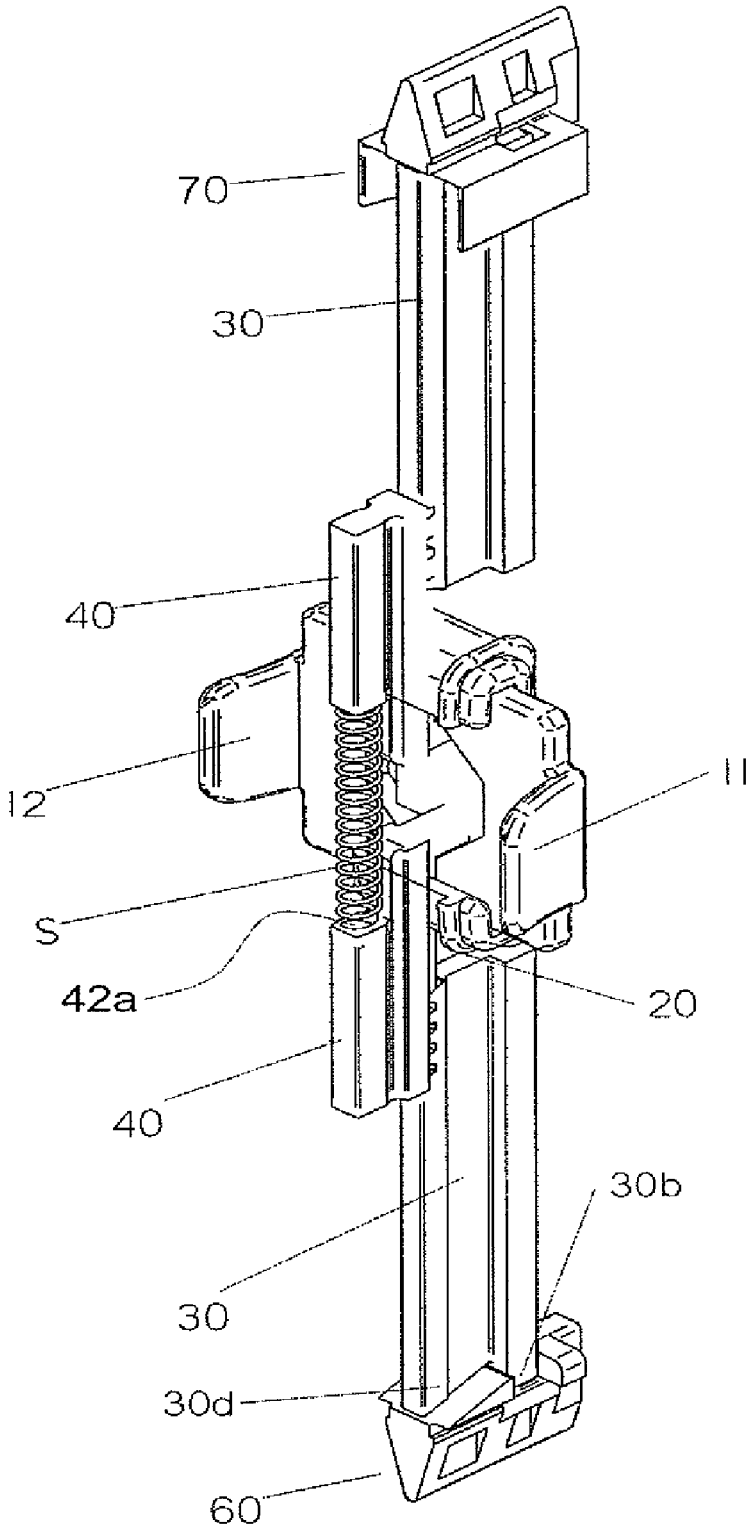
Figure 9G:
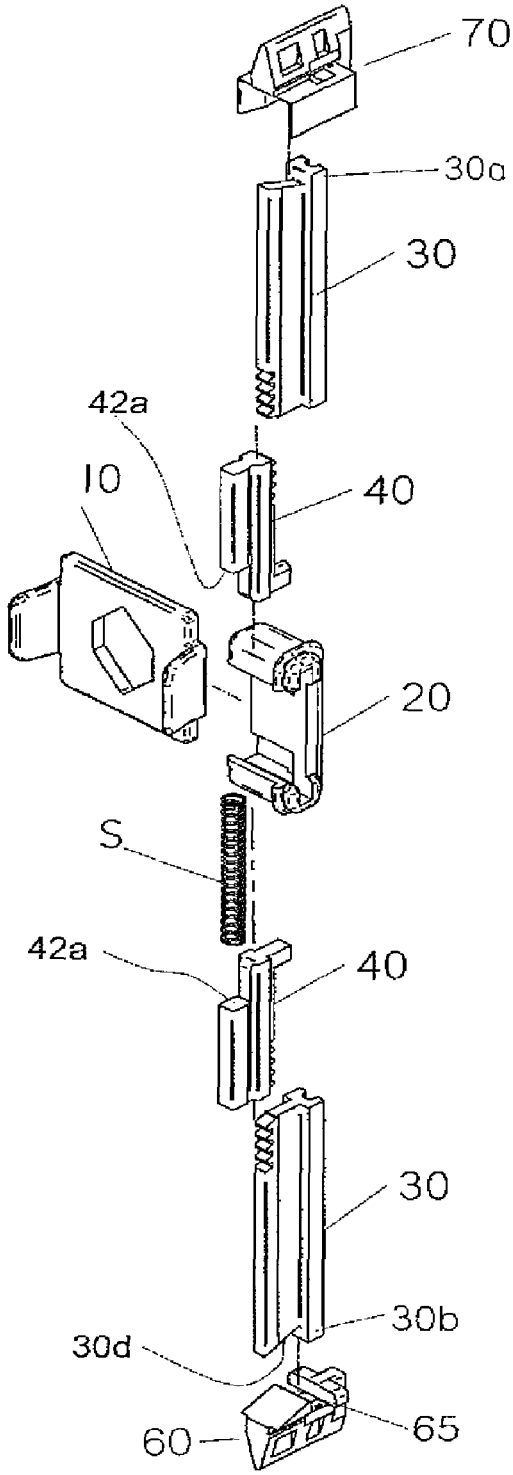
Figure 10:
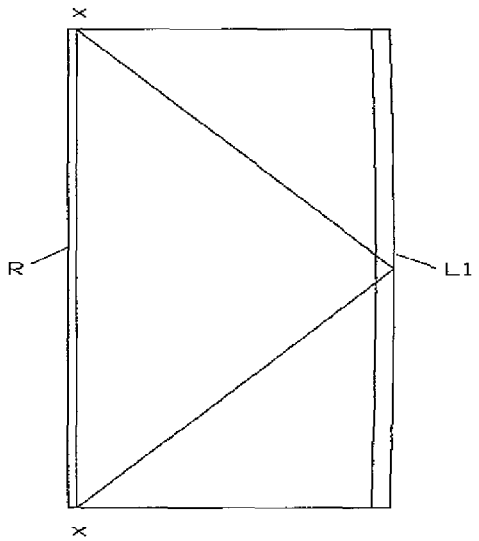
FIGS. 10 and 10A is a schematic view of the various forces exerted upon a roll out screen assembly by the provision of a center lock and a comparison of the distribution of the forces when using the latch engaging the sill and the header embodied in the present invention.
Figure 10A:
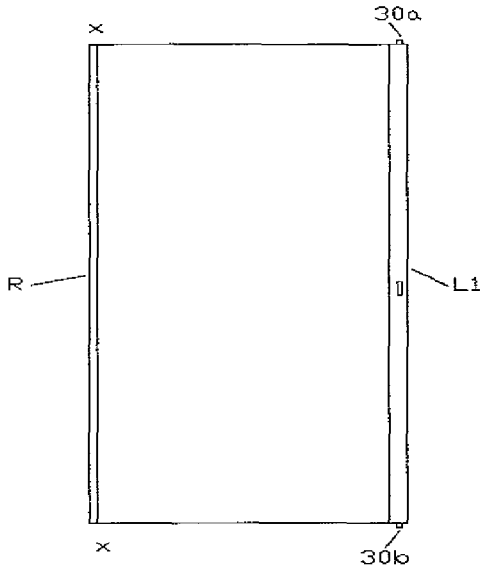
Figure 11:
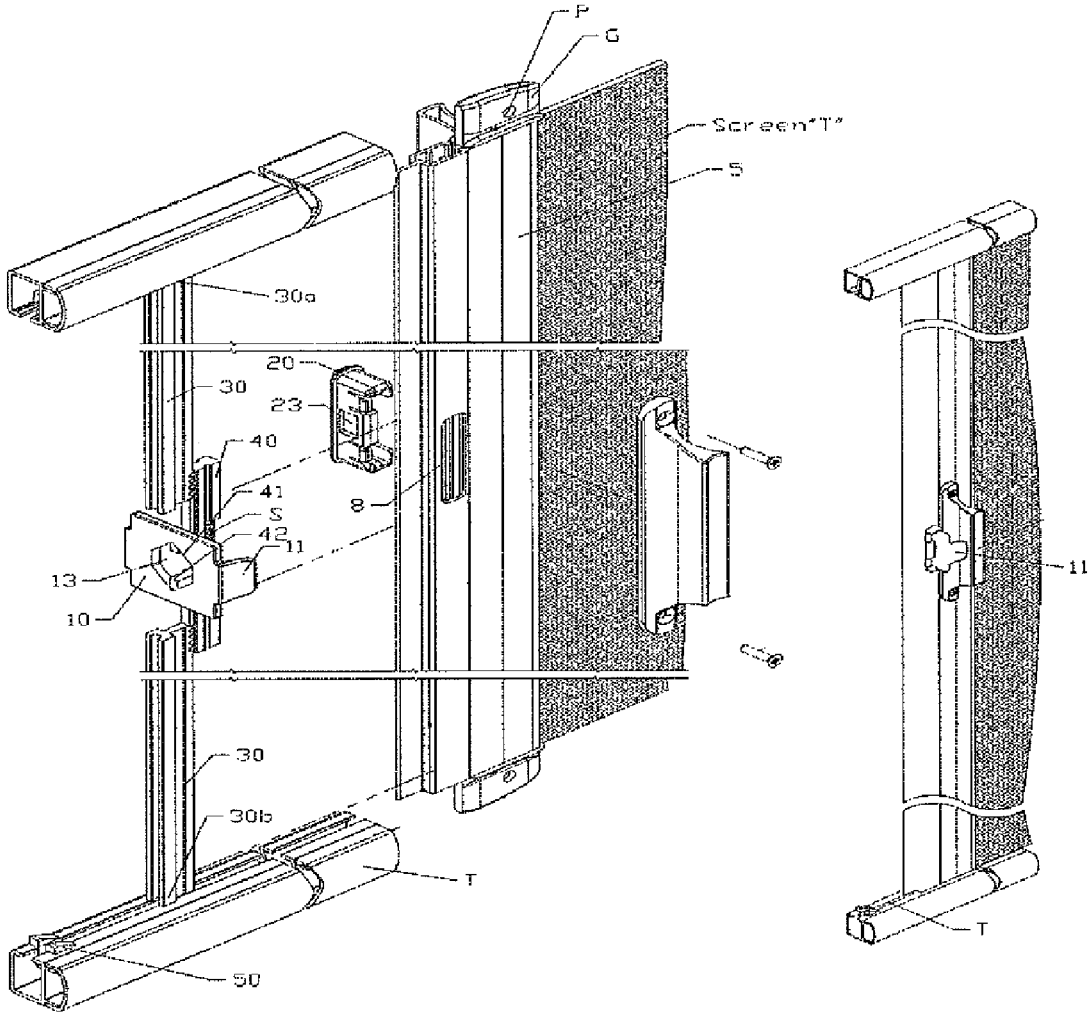
FIG. 11 is a perspective cut away view of the entire assembly showing the environment of use illustrated in a preferred embodiment of the invention.

Referring to the Figures in general and specifically FIG. 10, the problem being addressed, as discussed in the Background of the Invention relates to improving the performance of the latching mechanism for a roll up screen, to provide for latching proximate the header and sill tracks as best seen in relation to FIGS. 9D, 9E, 9F, 9G and 11. In order to accomplish this objective there is provided with the handle frame portion 5 as best seen in relation to FIGS. 1, 9D, 9E, 9F, 9G and 11 a simple latch assembly to be inserted within opening 8 of the handle frame part. As best seen in FIG. 11 the assembly includes a retaining bushing 20 which holds in position a cam member 10. The cam member 10 works in cooperation with pins provided with operators 40 as best seen in FIG. 1B itemized as part 42. The operator 40 engages with cam member 10 via the pins 42 so that when the grips 11 and 12 are moved in juxtaposed directions this action provides for the release of the latch mechanism and the latch operation. Release bolts 30 are provided with ends 30*a* and 30*b* for the respective latching and release of the release bolts that engage with the header and sill parts of the track. In order to operate the release bolts proximate 30*a* and 30*b*, operators 40 having ends 42*a* thereat carry there between a spring S to provide for the resilient biasing of the latch mechanism as best seen in the FIGS. 9F and 9G. As best seen FIG. 1B, the operators 40 engage the release bolts 30 proximate racks 41 and 31 for both the upper and the lower release bolts so that juxtaposed motion of the handle grips 11, and 12 will cause the pins 42 to ride on cam surfaces 14*c* and 14*b* so as to, in one embodiment, arrive at position X (see FIG. 3) while cam member 10 moves to the opposite direction, pins 42 rides on cam surface 14*d* and 14*a*. The pin for the header release bolt will arrive at position X from position A and, the pin for release bolt for the sill release portion will arrive at point X from point B. The operation of the grips by either the inside user or the outside user will result in unlatching, that is releasing, the portions 30*a* and 30*b* from the track portions so that the screen may be moved across the track to and from its operable position to its fully accumulated position. The release bolt therefore will travel within the channel 6 within the handle frame part 5 and the operator portions 40 (as best seen in relation to FIGS. 1C and 2) will travel within channel portion 7 also of the handle frame part.

Figure 1:
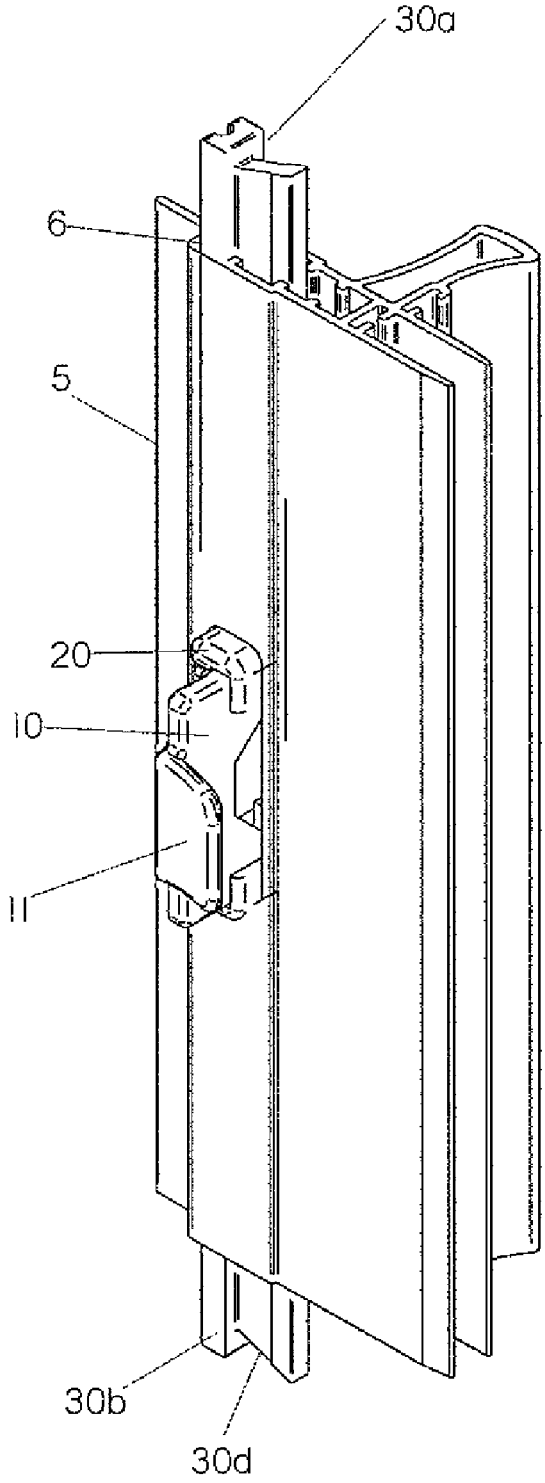
FIG. 1 is a perspective view of the latch assembly illustrated in a preferred embodiment of the invention.
Figure 1A:
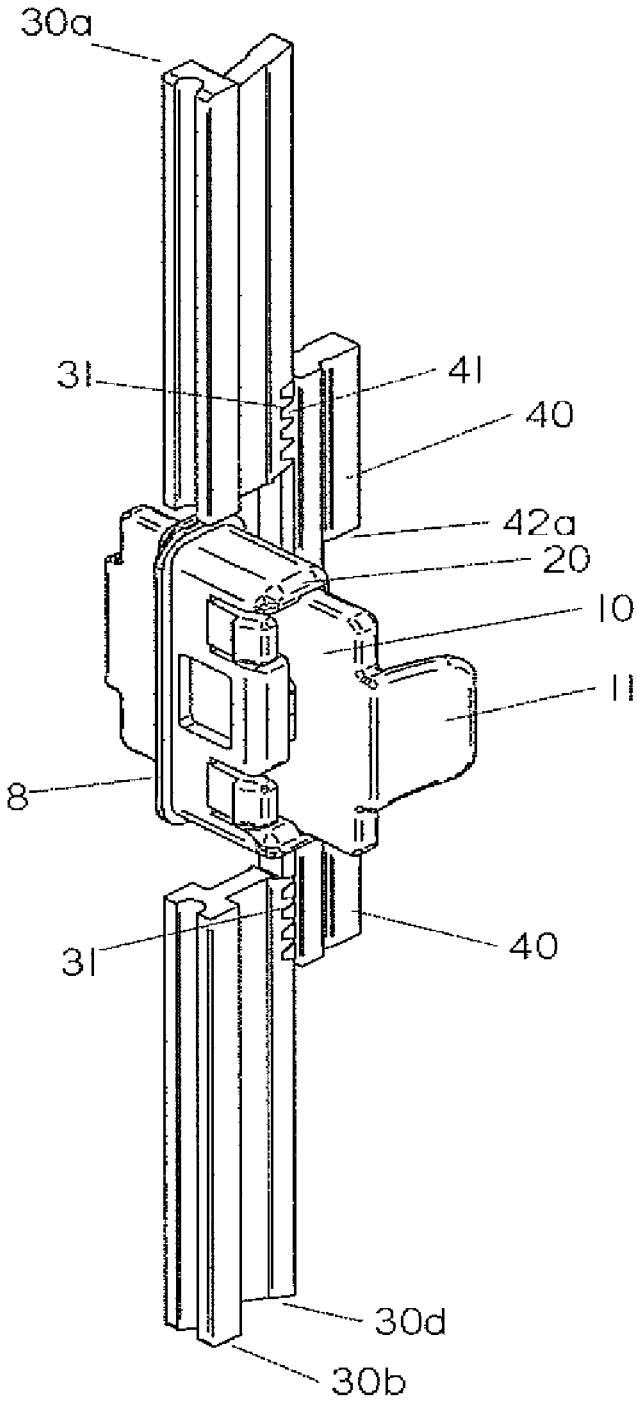
FIG. 1A is cut away perspective view of the view of FIG. 1.
Figure 1B:
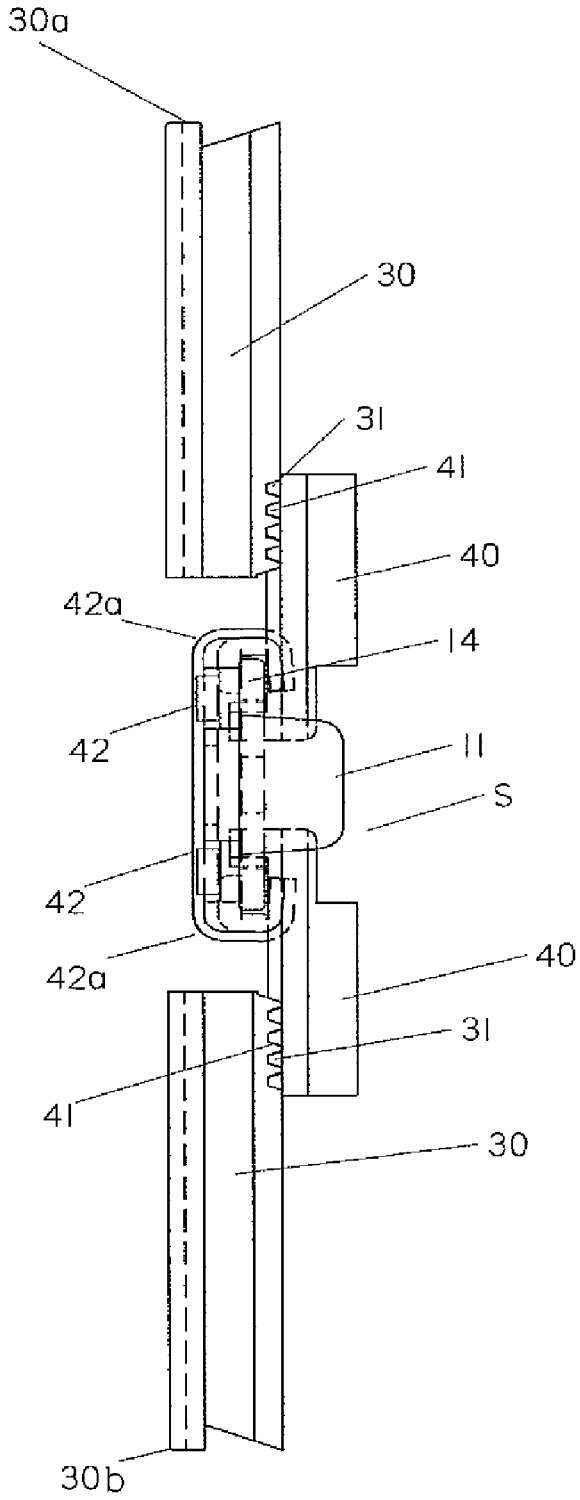
FIG. 1B is a side view of the assembly of FIG. 1A.
Figure 1C:
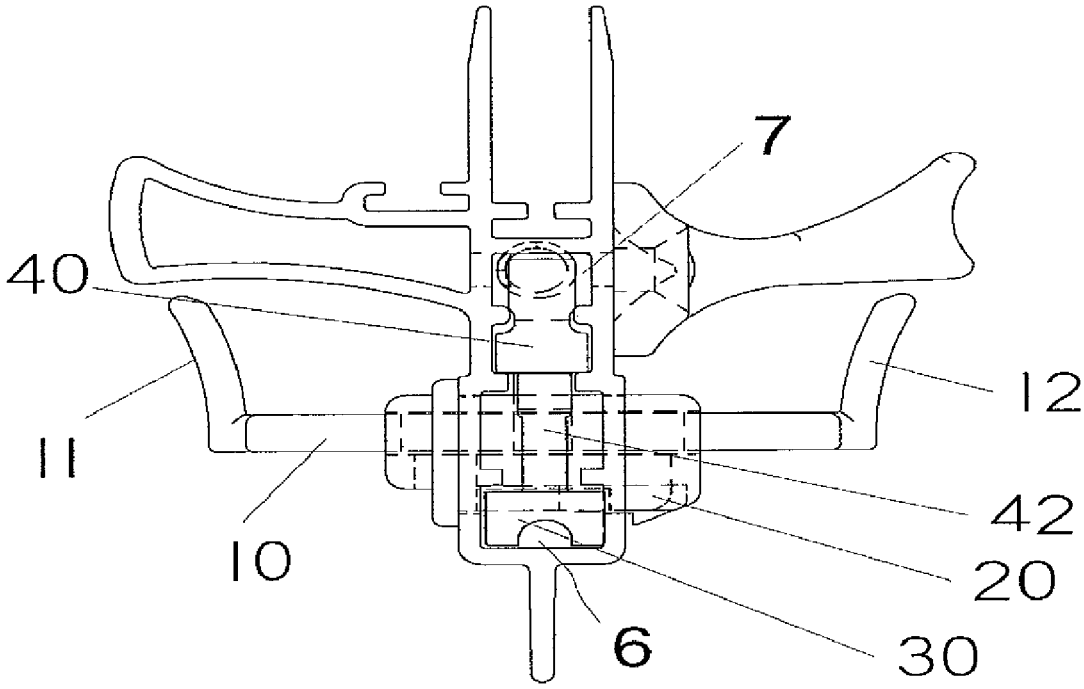
FIG. 1C is a top view of the assembly of FIG. 1 through the center of camming member 10.
Figure 2:
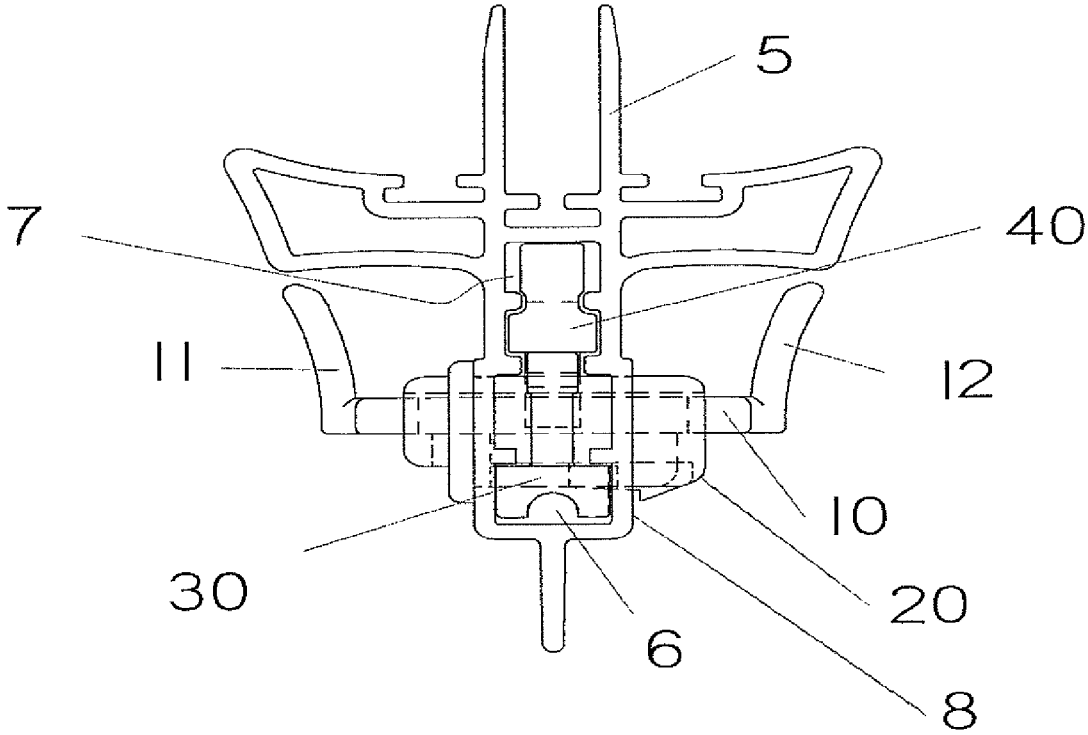
FIG. 2 is a similar view to that shown in FIG. 1C with the exception that no inter-engagement of the parts is illustrated.
Figure 3:
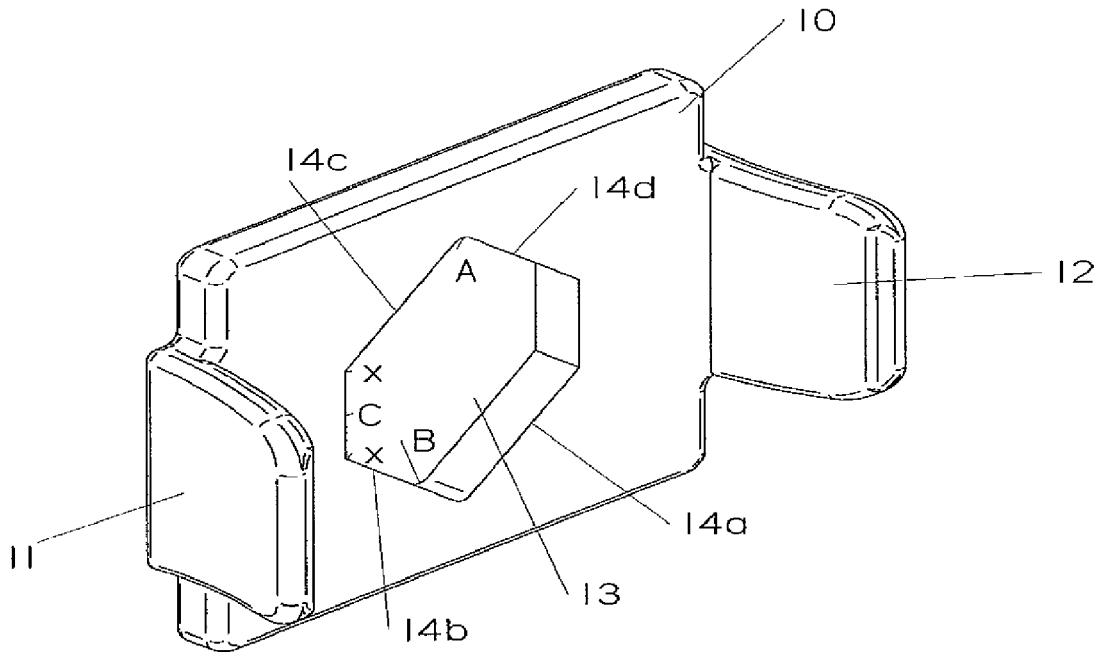
FIG. 3 is a perspective view of the camming member 10 illustrated in a preferred embodiment of the invention.
Figure 4:
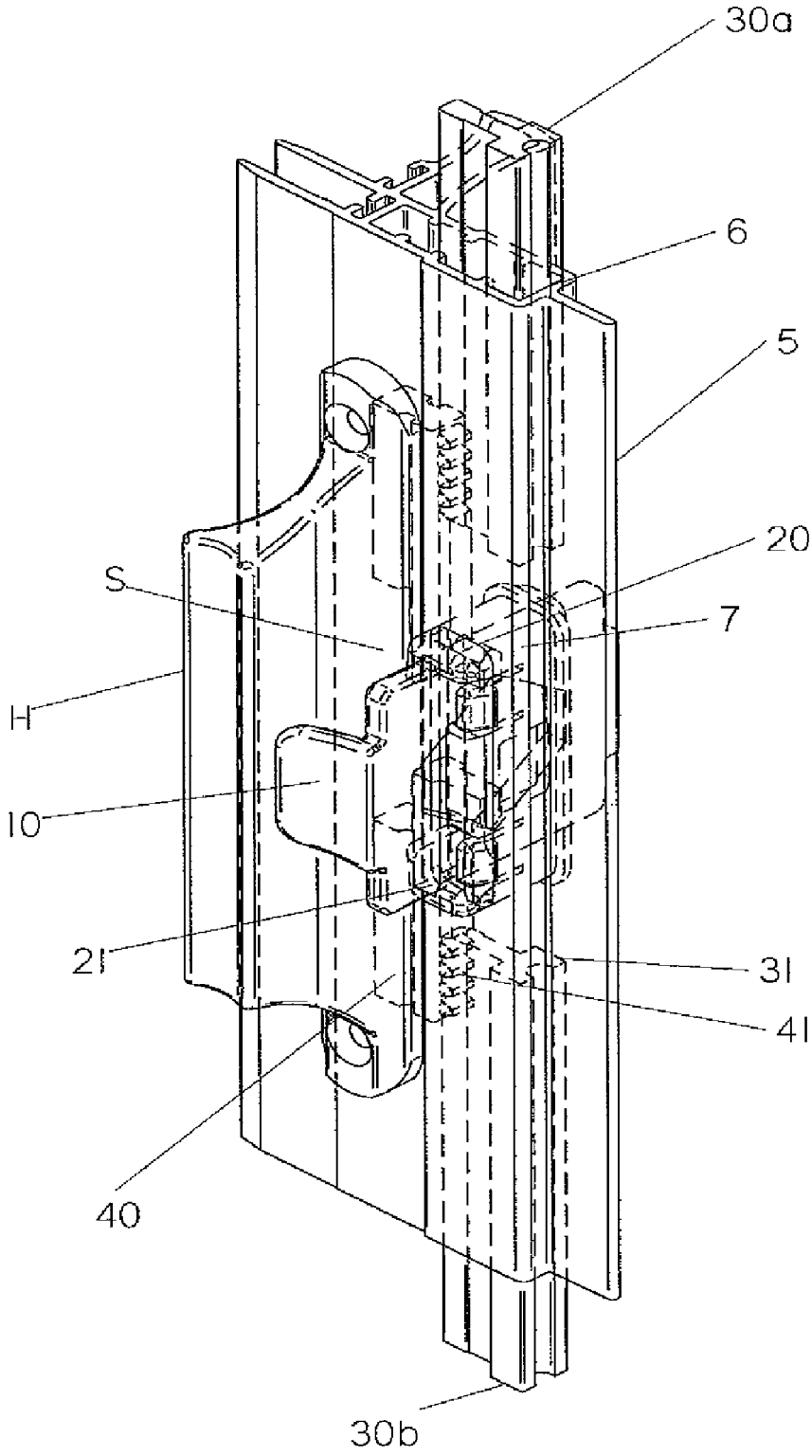
FIG. 4 is a cut away perspective view of the operating parts of the invention showing the inter-engagement of the operators 40 with the release bolts 30.
Figure 5:
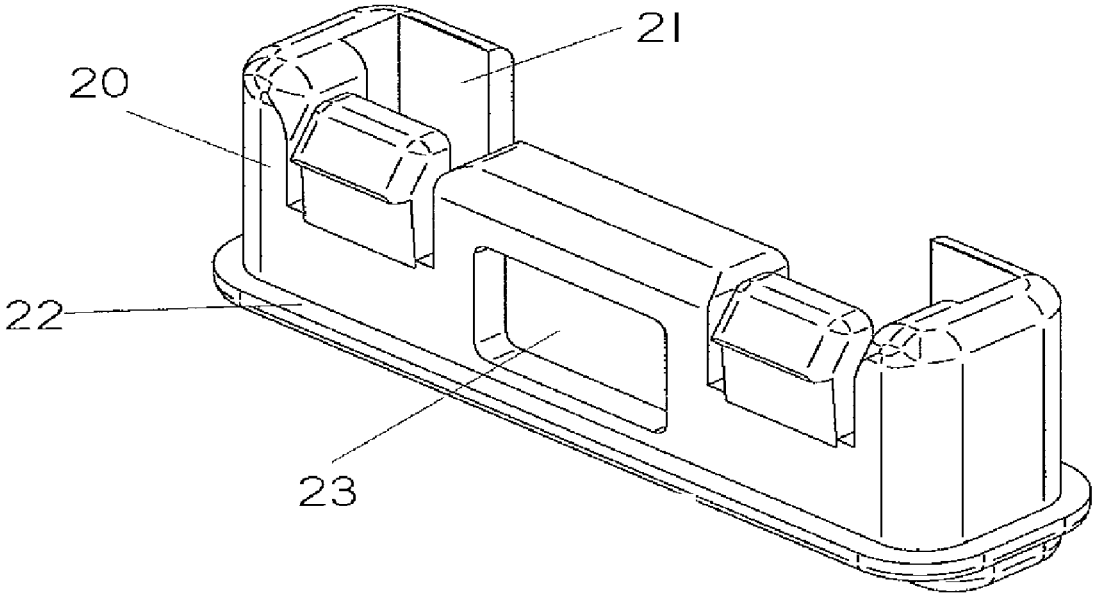
FIG. 5, FIG. 5A, and FIG. 5B are various views, typically perspective illustrating the inter-relationship of the release bushing 20 and the various parts thereof illustrated in a preferred embodiment of the invention.
Figure 5A:
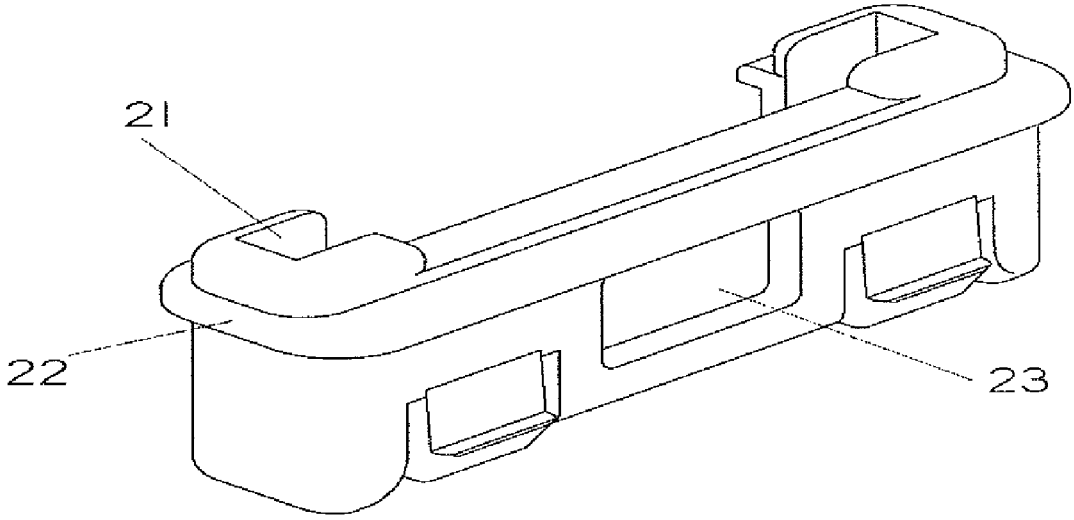
Figure 5B:
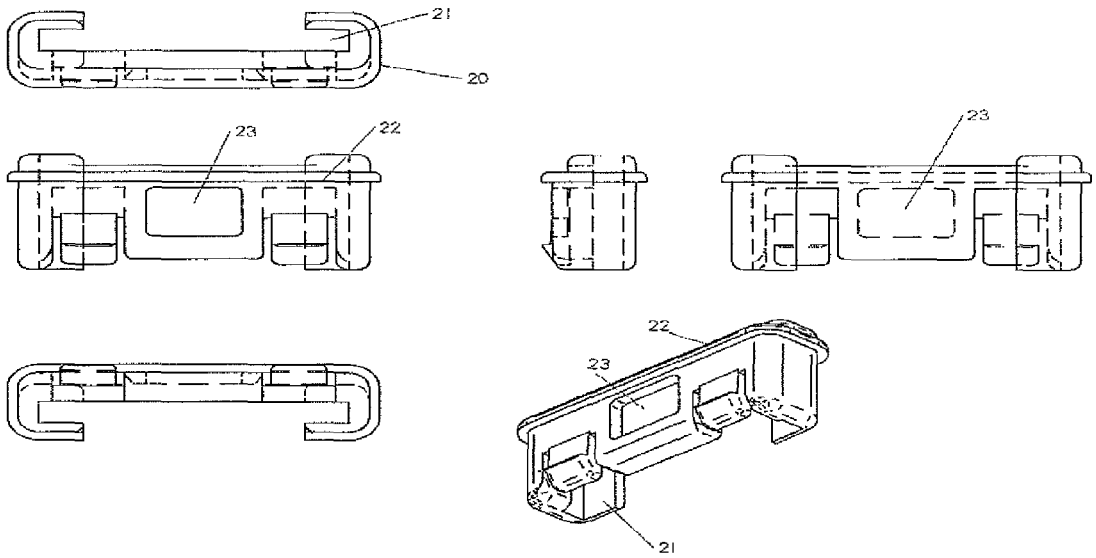
Figure 6:
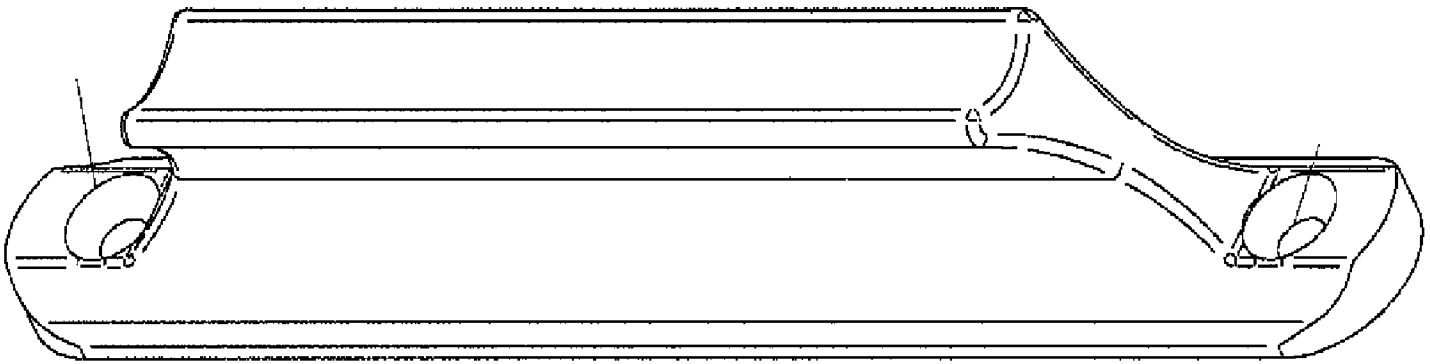
FIG. 6 is a perspective view of a handle H illustrated in a perspective and a preferred embodiment of the invention.
Figure 7:
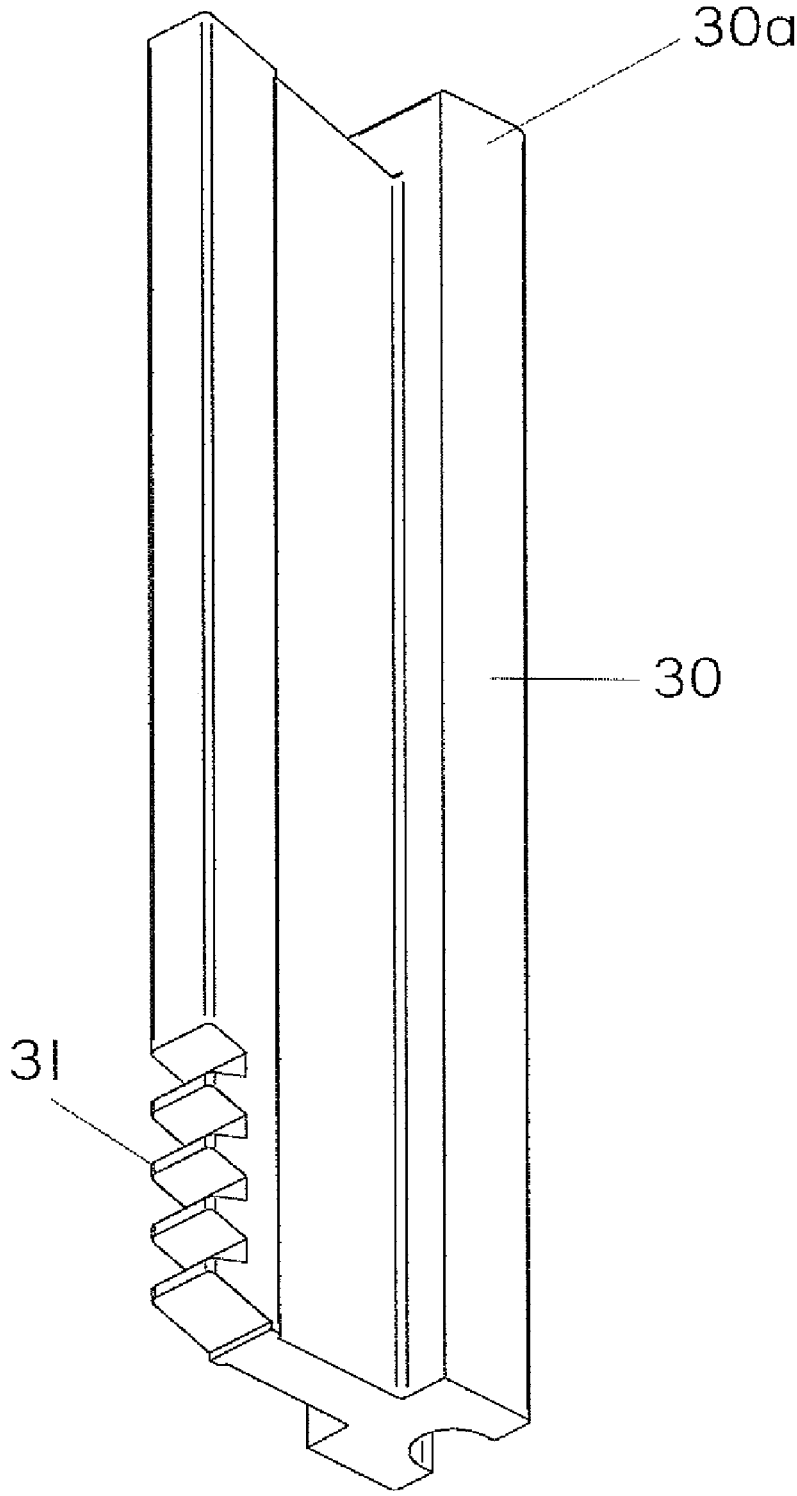
FIG. 7 is a perspective view of the release bolt 30 illustrated in a preferred aspect of the invention.
Figure 7A:
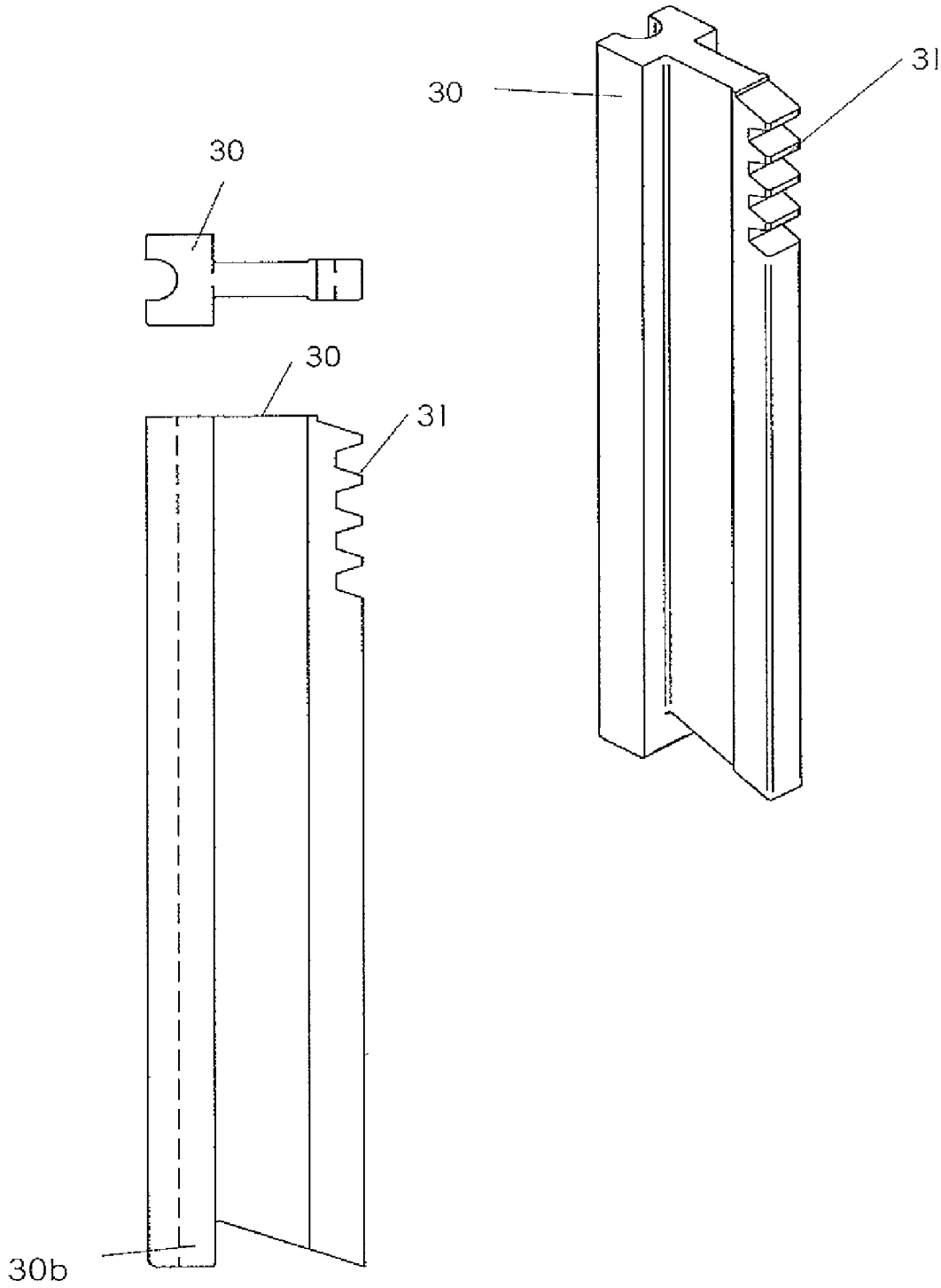
FIG. 7A includes an end and the side view of the release bolt of FIG. 7.
Figure 8:
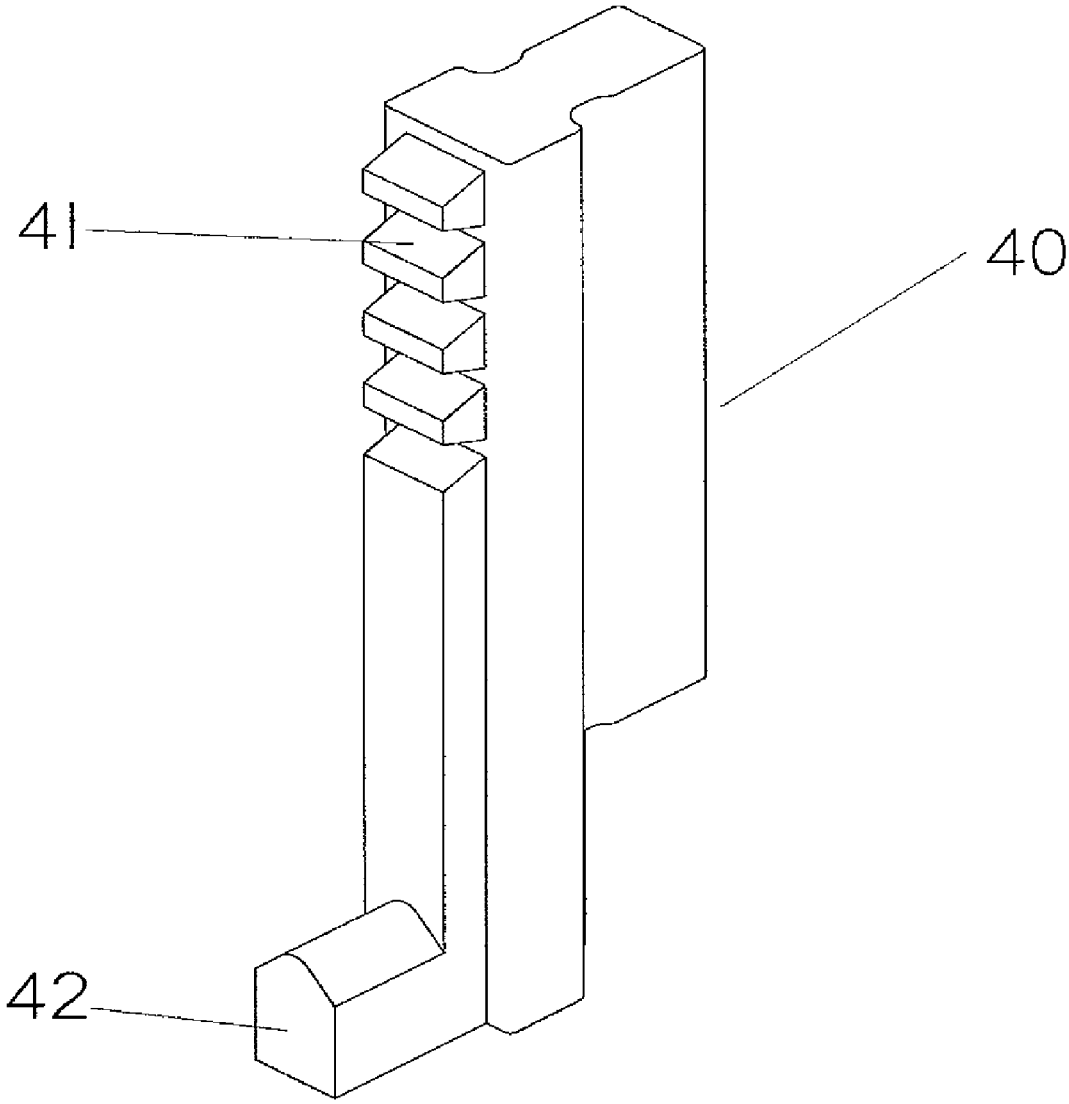
FIG. 8 and FIG. 8A are various views including perspective and side and top views of the operator 40 illustrated in a preferred embodiment of the invention.
Figure 8A:
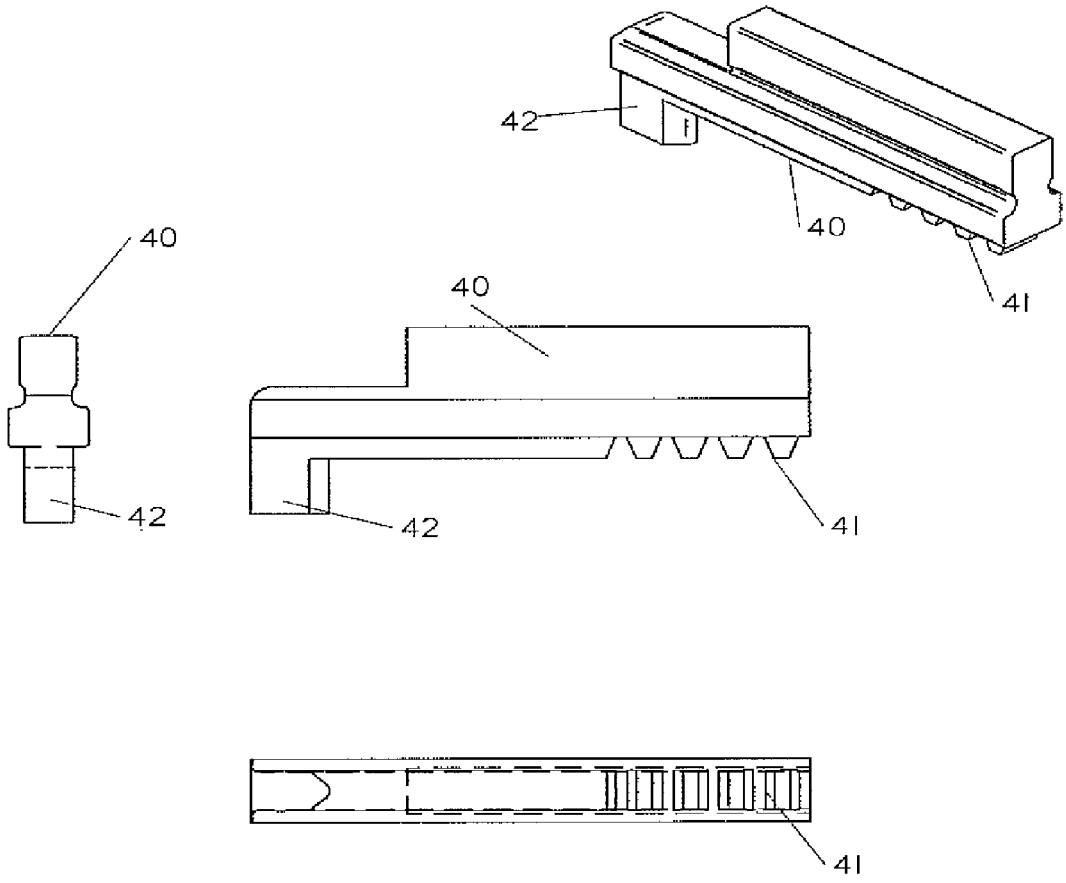

Referring now to FIGS. 5, 5A and 5B and also in relation to FIG. 1B, FIG. 1C, and FIG. 2, the retainer bushing 20 includes a rim portion 22 which retains the cam member in position as best seen in relation to FIG. 1 proximate the rim or flange 22. The cut out portion 23 allows for the operator pins 42 to pass through the assembly as best seen in FIG. 1B to engage the camming surface 14 within cut outs 13 of cam member 10. However the operators 40 do not ride within nor are they contained within the fastening retainer bushing 20. The cam member 10 is therefore inserted within the slot 21 to extend through the retainer 20, held in cut out 8 of the handle frame, so as to position the cam surfaces in alignment with window 23 of said retainer 20 so that the pins 42 can align within the cam member through windows 23 so as to provide operation and motion of the release bolts 30.

FIG. 7, 7A, 8 and 8A illustrate the rack portions of 31 and 41 of both the release bolt 30 and operator 40 which interengage, as best seen in relation to FIG. 1*a* and 1*b* to provide for the release of the latch assembly.

Referring now to FIGS. 9, 9A, 9B and 9C, the block element 50 is illustrated in various embodiments having ramp portions 51 and butting faces 52, to be installed within the header and sill track parts via the fasteners (not shown) located in the channel 53. When the block 50, 60 or 70 (for use preferably with the header only) is located in the track of both the sill and header as best seen in relation to FIGS. 9D, 9E, 9F, 9G and 11, the release bolts 30 will therefore ride up the ramp 51 or 61 or 71 and then because of the spring tension on the screen assembly, the release bolts will engage the butting face 52, 62 or 72 and be prevented from returning the roll screen assembly to the fully accumulated position because of the engagement of the butting face 52, 62, 72 with the bottom end of the release member at 30*b*, until such time as the grip of the camming member is moved using either the inside or the outside grip to cause the motion of the release bolt and allow for the movement of the roll screen to the fully accumulated position.

Referring now to FIGS. 9A, 9B, 9C, 9D, 9E, 9F and 9G there are illustrated in perspective the details of the operation of the latching aspect of the present latch assembly. There is provided therefore a block 60 to be installed within a track portion of an assembly as best seen in relation to FIG. 12A. Said block portion 60 including a generally tapered portion 67, the block 60 to be inserted within the track portion with the flanges of the track resting under bottom 66 of the ramp portion 61. This will also be the case with respect to block 70 when inserting the block 70 within the header section. Each block assembly 60 or 70 includes a stop portion 64 or 74 including a butting surface 63 and a cutout 65 within which the latching detents 30*b* and 30*a* are accommodated as best seen in relation to FIG. 9D. It will be noted that the block 60 is utilized on the sill and that block 70 is utilized in the header but alternatively the opposite may be true as well. As best seen in FIG. 9B the block 70 is substantially similar to block 60 in many respects with a butting face 72, a tapered portion 77, a ramp portion 71 and a built in stop portion 74 with a butting face 73 and a cutout 75. The main difference is that block 70 includes side part 76 including a funnel shaped mouth at 70*a* to guide the leading edge of the screen draw bar into the block proximate the header of the assembly thereby guiding the draw bar to its latched position. This feature may also be present at both the header and sill. It was found that without providing the assembly with a block such as block 70 there was a tendency for the draw bar to roll at its latched position and therefore following many many uses of the screen for example, of a patio door, that by the repeated use thereof the action and location of the draw bar of the latch assembly was not assured as would be the case by the provision of the block 70. Therefore as best seen FIG. 9F the latching position of the release bolt 30 is clearly shown being secured in position with the latching detent 30*b* resting within the cutout 65 of the block 60 which is identical for block 70 which is unable to be seen in that view. But the operation thereof is consistent with that which is previously described.

Although the present invention has been described in relation to a roll screen assembly it would work equally well with a standard screen assembly which is basically installed in a rectangular frame. The working elements would be identical and it would provide for a simple latch for such an assembly.

Figure 15:
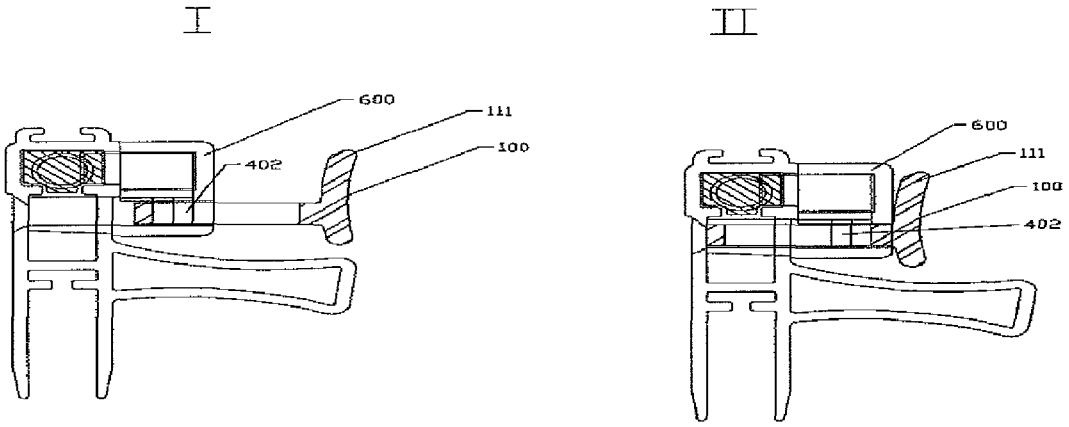
FIG. 15, 16 and 17 illustrate an alternative embodiment of the invention for window assemblies showing the difference in the construction of the camming member which includes only one grip portion.
Figures 16, 17:
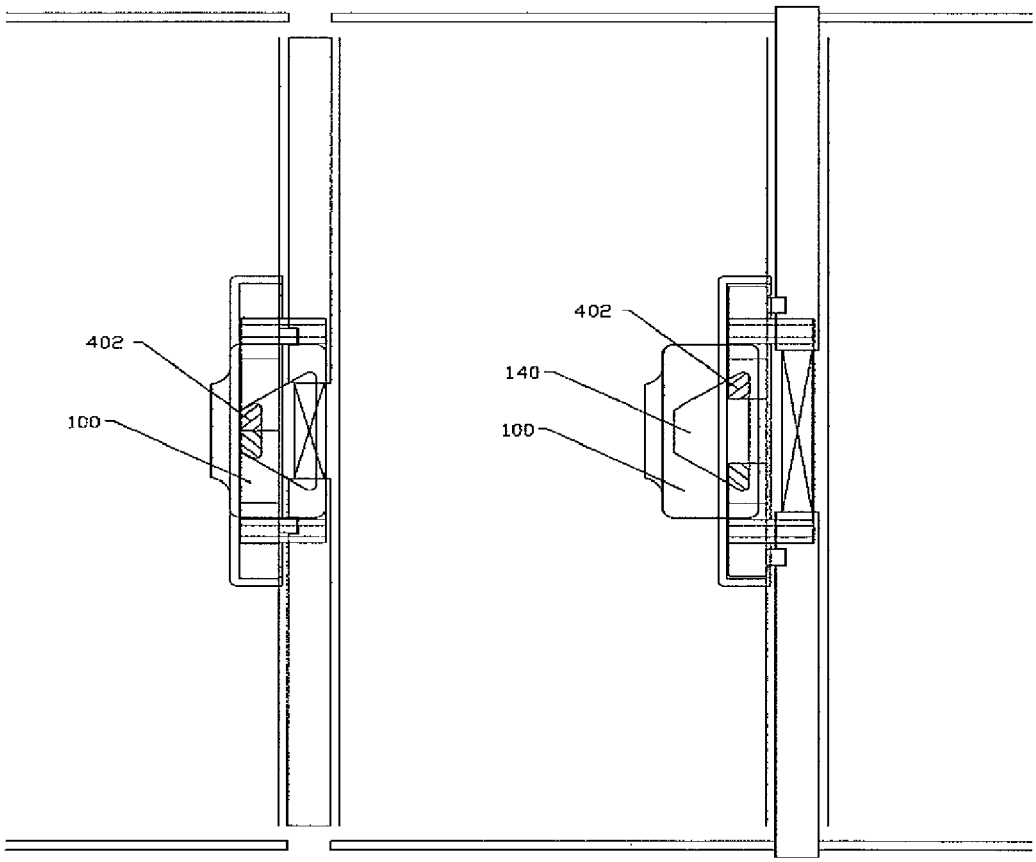

Alternatively the entire assembly may be embodied in a window screen assembly, instead of the preferred embodiment which is for a patio door assembly. The camming member would include a cut out that is not generally diamond shaped as in the case of the present preferred embodiment shown in FIG. 3, but would be a truncated triangle shape as seen in FIGS. 15, 16 and 17 since there would be no need or provision for the two way operation. The latch assembly for a window would only need to be operated from the inside and therefore the portion on the left of the view of FIG. 3 would be included and the portion on the right of the view of FIG. 3 would be excluded resulting in the structure seen in FIGS. 15, 16 and 17.

All portions are preferably made from nylon but other thermoplastic material such as acetal would also be functional.

Figure 12:
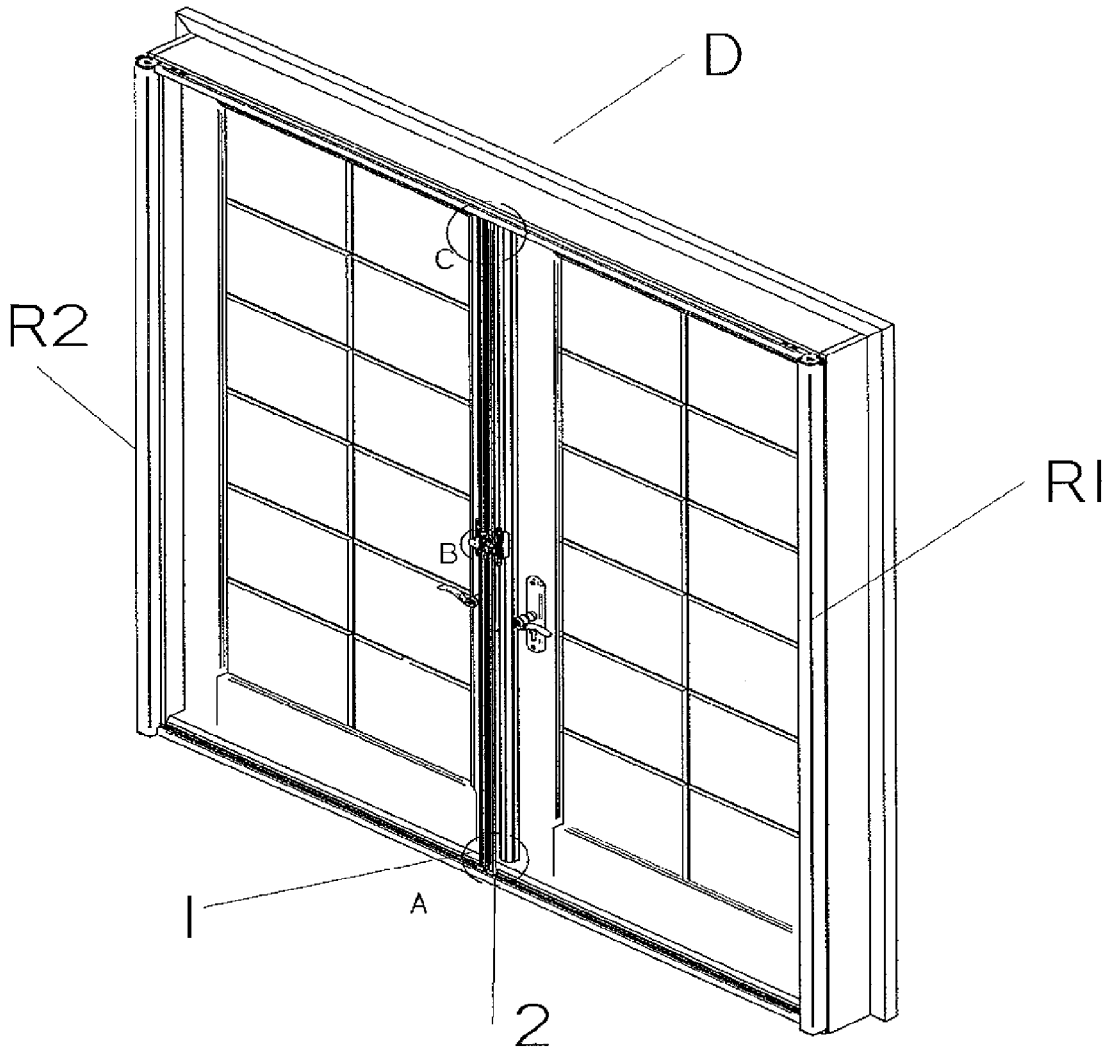
FIG. 12 is a perspective view of the French door embodiment of the latch assembly of the invention illustrated in perspective and in an alternative embodiment of the invention.
Figure 12A:
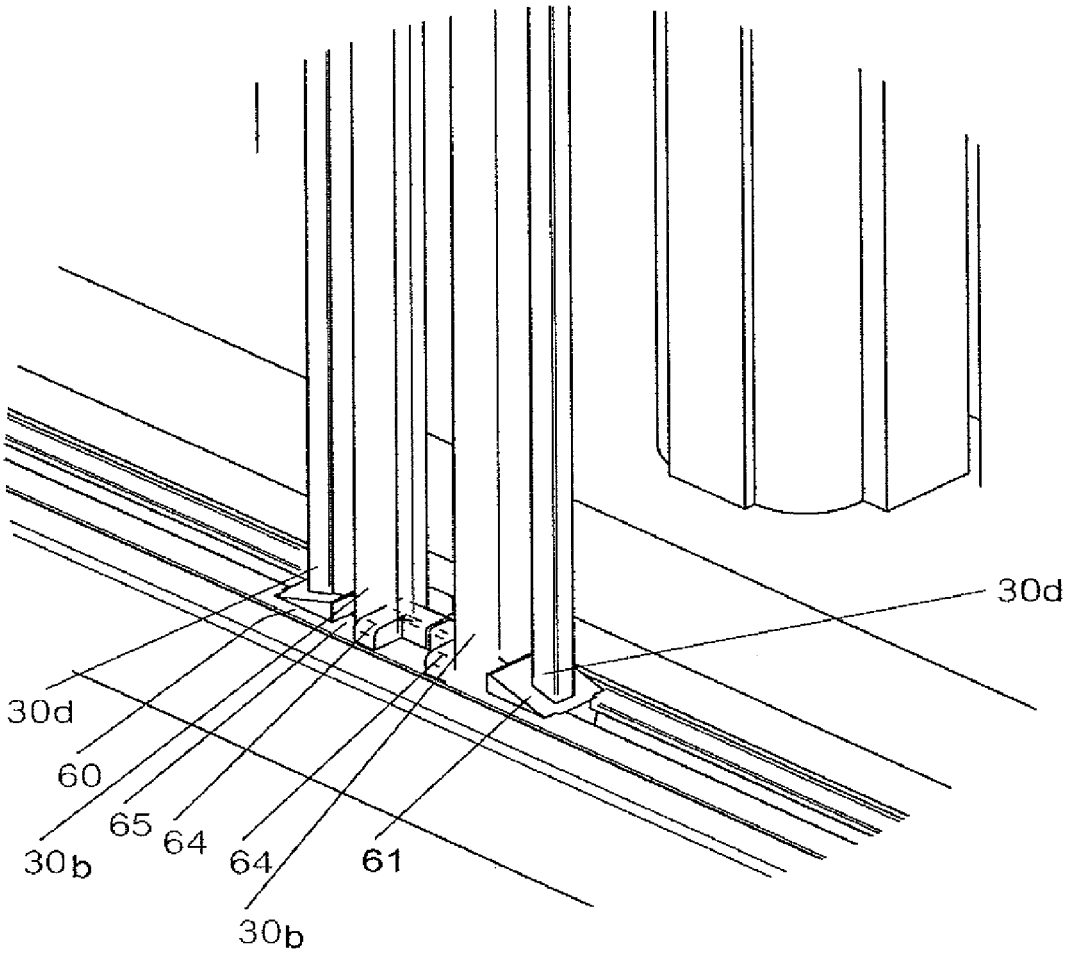
FIG. 12A is a close-up perspective view partially cut away with respect to the area A of FIG. 12 illustrated in a preferred embodiment of the invention.
Figure 12B:
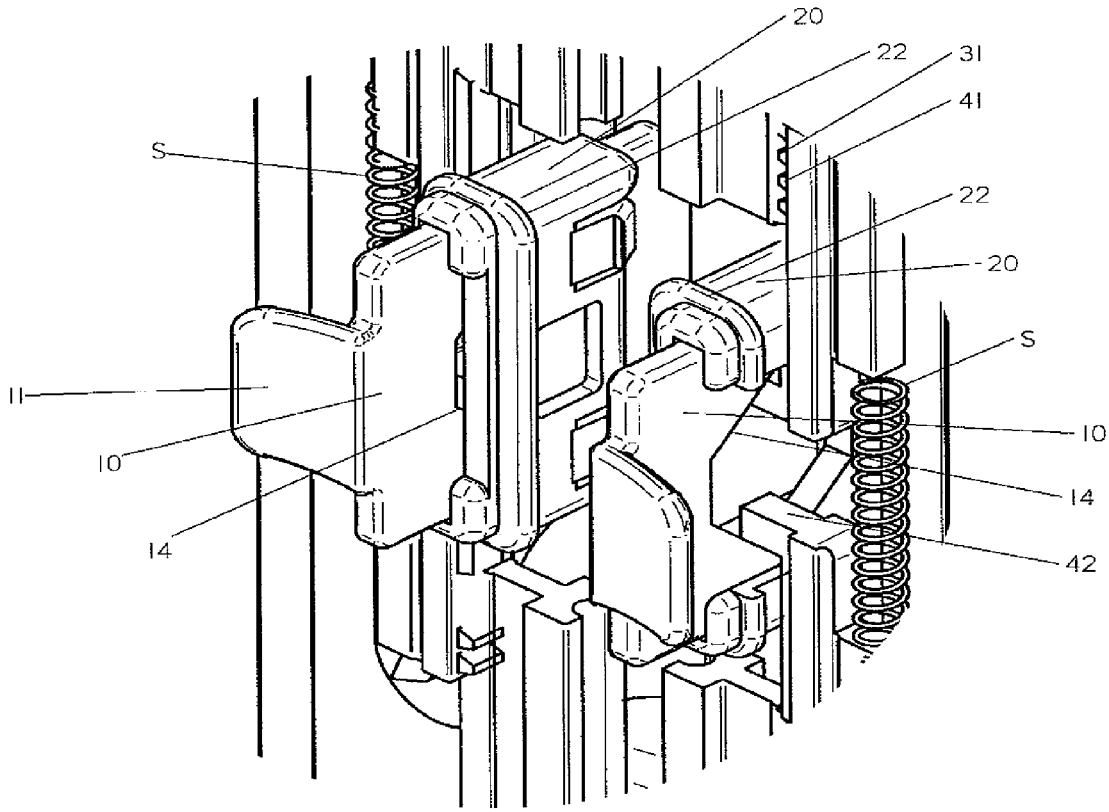
FIG. 12B is a cut away perspective view of the latch assembly of FIG. 12 and specifically the area B indicated on that figure illustrating the interrelationship of the components for the French double-door embodiment.

Rather than the embodiments shown in FIG. 11 it is also possible to install the roll screen assembly within a French door installation so that dual roll screens would be utilized as seen in FIG. 12. In this case the two screens would be in line, namely they butt up against each other and the provision of a ramp assembly 60 and 70 in the track in the sill and the header respectively as seen in FIGS. 12, 12A and 12B would define the latching position of the French door screens at a position that could also be offset to the center position where the two French patio doors would normally meet.

In order to assemble the latch assembly, it is a simple matter of providing a cut out in the draw bar as shown in FIG. 11, as 8, so as to provide for the location of the retainer bushing which is placed in position for accepting the cam member 10. Once in place the bolts 30 and the operators 40 are slid into position through track channels 5 and 7 as best seen FIG. 2 until such time as the pins 42 best seen in FIG. 1B ride within the cutout 13 and engage the cam surfaces 14, which are substantially diamond shaped. A resilient biasing of the assembly is available by the provision of the spring S between the operators as best seen in FIG. 1B and 9F. The assembly is now complete and one merely preferably provide the block portions 50, 60 and 70 within the tracks to provide for the most reliable operation of the assembly.

Referring now to FIG. 12 there is illustrated a French door embodiment D including two screen draw bars 1 and 2 for the dual door assembly. The details of the French doors per se are not included since they do not constitute part of the present invention. In the present illustration of FIG. 12 there is provided roll screen housing R1 and R2 installed on opposite jambs of the French door assembly with handles 1 and 2 for supporting the screen at the free end of the roll screen which is not shown for simplicity sake. There is indicated on FIG. 12 areas A, B and C the details of which will follow hereinafter. Referring to FIG. 12A there is illustrated in perspective a close-up of how the draw bar assembly 1 and 2 includes latching portions 30*b* within the sill of an assembly. The track portion includes inserted therein proximate the position where the screens come together the block portion 60 to define the latching positions in relation to the ramp surfaces 61 and the cutout 65 wherein the portion 30*d* of the release bolt for each screen assembly rides up on the ramp section 61 of block 60 until the pin portion 30*b* will fall in position behind the integral stop 64 of the block 60 thereby latch the latch assembly in position until such time as the grip of the camming member is operated. Referring to FIG. 12B clearly it can be seen as was described in prior descriptions that in the case of the French door assembly two cam members 10 are provided with cam surfaces 14 so that pins 42 may ride on the cam surfaces and reach the desired latched and unlatched positions previously described. So when the screen draw bars are in the position as seen in FIG. 12A the user may operate either or both of the roll out screens of FIG. 12B in order to pass through the opening for the French doors or for some other purpose. Otherwise the assembly is identical in operation to a single screen assembly but the aesthetic nature and value of French doors is easily accommodated with the present invention.

Figure 13:
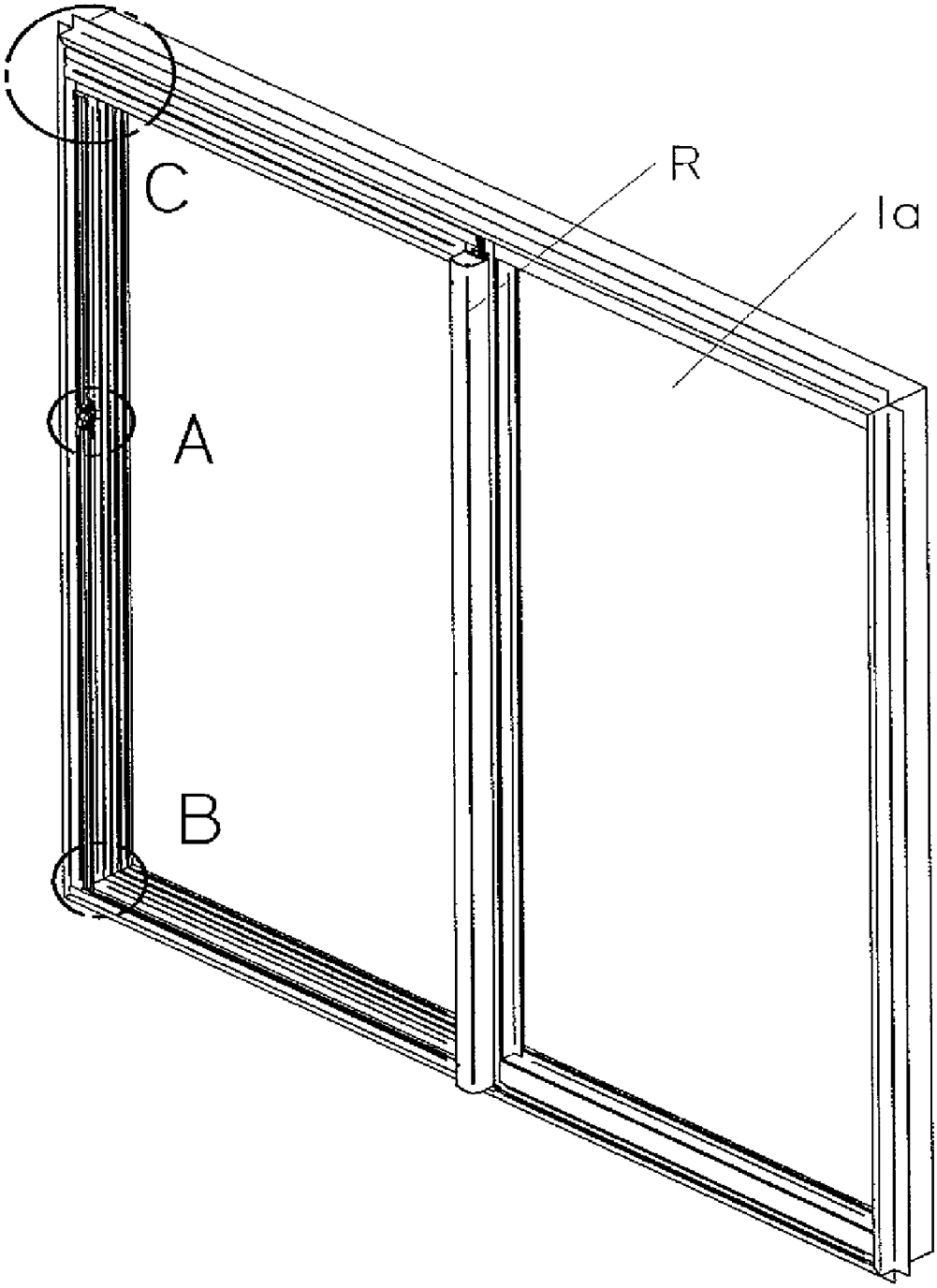
FIG. 13 is a perspective view of the patio door embodiment of the latch assembly of the invention illustrated to include areas A, B and C.
Figure 13A:
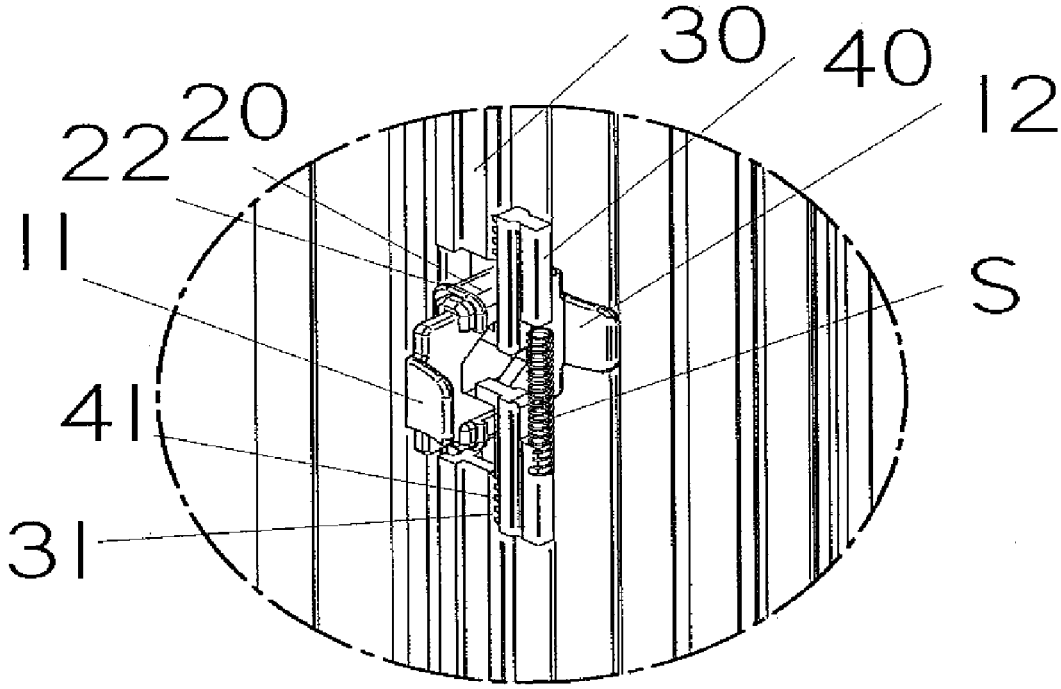
FIG. 13A is a perspective view partially cut away of area A of FIG. 13.
Figure 13B:
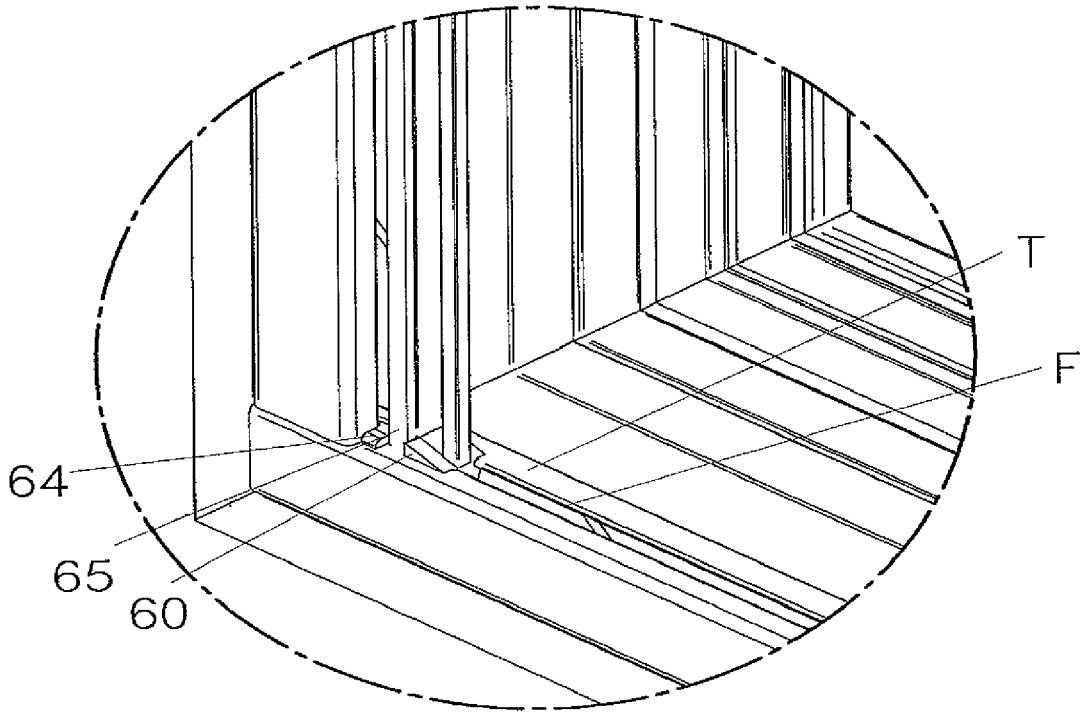
FIG. 13B is a perspective view of area B of FIG. 13.
Figure 13C:
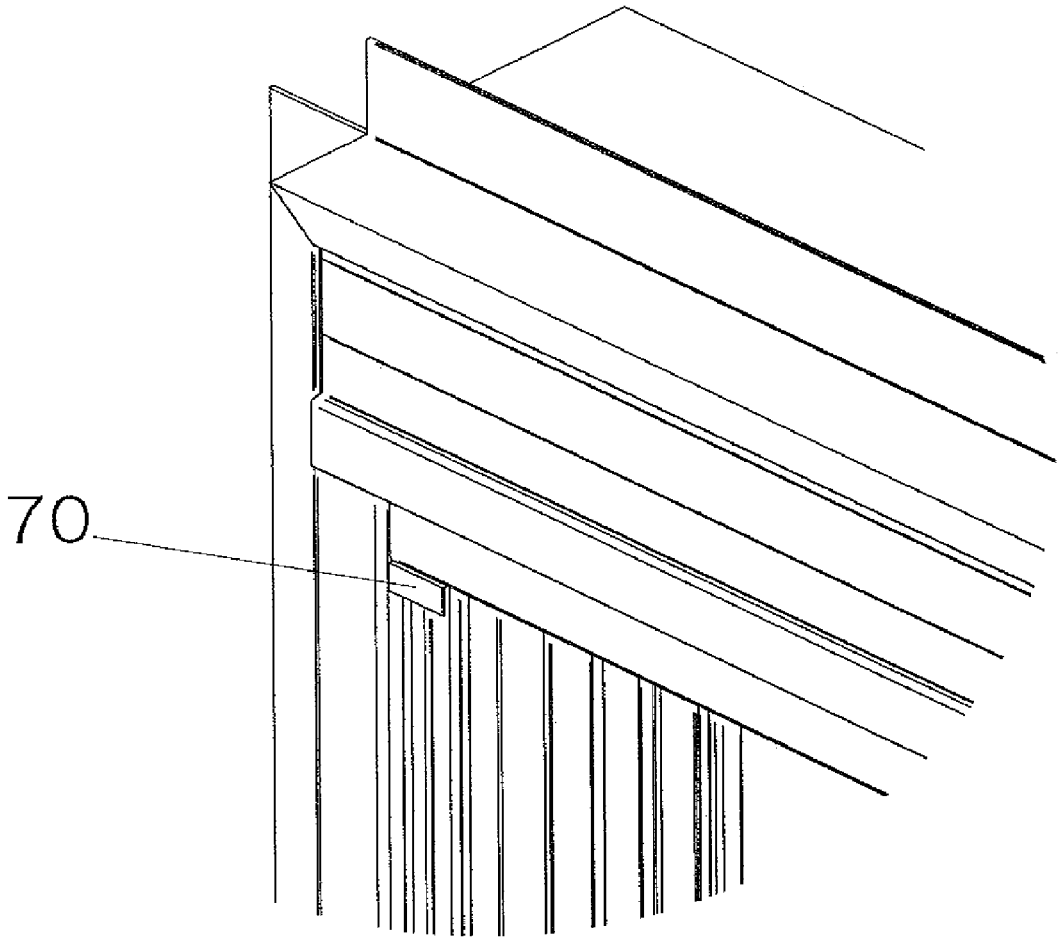
FIG. 13C is a close-up perspective view of the upper edge of the patio door assembly of FIG. 13 showing the block portion 70.

Referring now to FIGS. 13, 13A, 13B and 13C there is illustrated a patio door assembly with a roll out screen R installed within a patio door 1*a* which includes the typical details of a patio door assembly which details are not provided herein as they do not constitute part of the invention. Also shown in FIG. 13 are circled areas A, B and C the details of which are illustrated in the Figures that follow namely FIGS. 13A, 13B and 13C with details similar to those illustrated in relation to the French door embodiment. The details of the latch assembly therefore are repeated herein as best seen in FIG. 13A shown in cut away with the release bolts 30 extending toward the header and sill as the cam member 10 is accessed by grips 11 and 12 causing the pins 42 to rise on the cam surfaces 14 so that the operators 40 being spring biased may engage the release bolts 30 proximate racks 31 and 41 to cause the release action of the assembly. The spring portion S will provide sufficient biasing of the latching detents 30*b* and 30*a* to the locking block portions 60 and 70 so as to provide compression of the spring as these detents ride up the ramp portion of the respective blocks resulting in the detents 30*a* and 30*b* falling into position into the pockets 65 and 75 once the screen draw bar reaches the latching position. This is best seen in relation to FIG. 13B. The blocks 60 and 70 are installed within the track portions T between the flanges F and the channel therebetween by a press fit with the flanges proximate the bottom of the block at 67 and 77 clipping in place as may best be seen in relation to the FIGS 9A, 9B and 9C provided in relation to the block structure.

Figure 14:
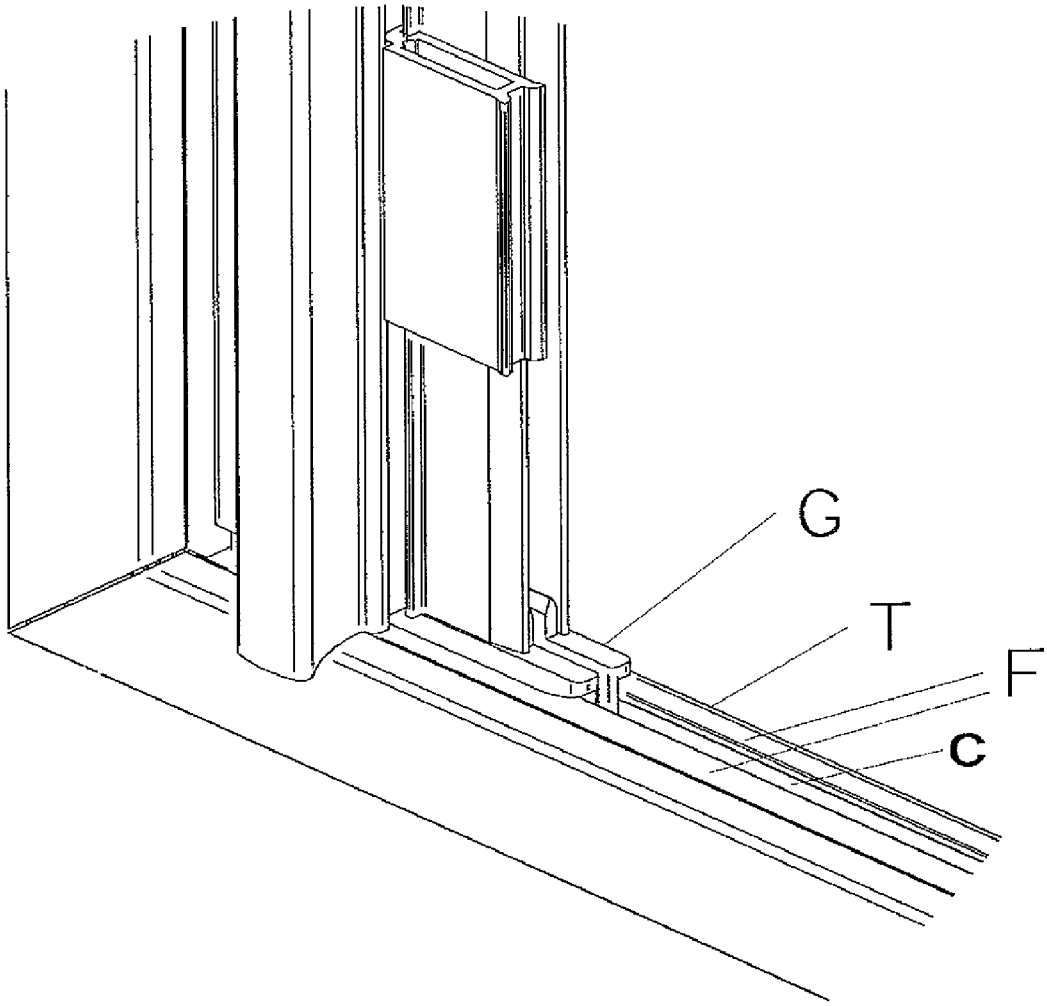
FIG. 14, 14A and 14B are illustrations of an entry door embodiment of the present invention illustrating in perspective and in cross-section showing the elements of the latching aspect of the invention as the screen is guided to and from an accumulated position and illustrated in a preferred embodiment of the invention.
Figure 14A:
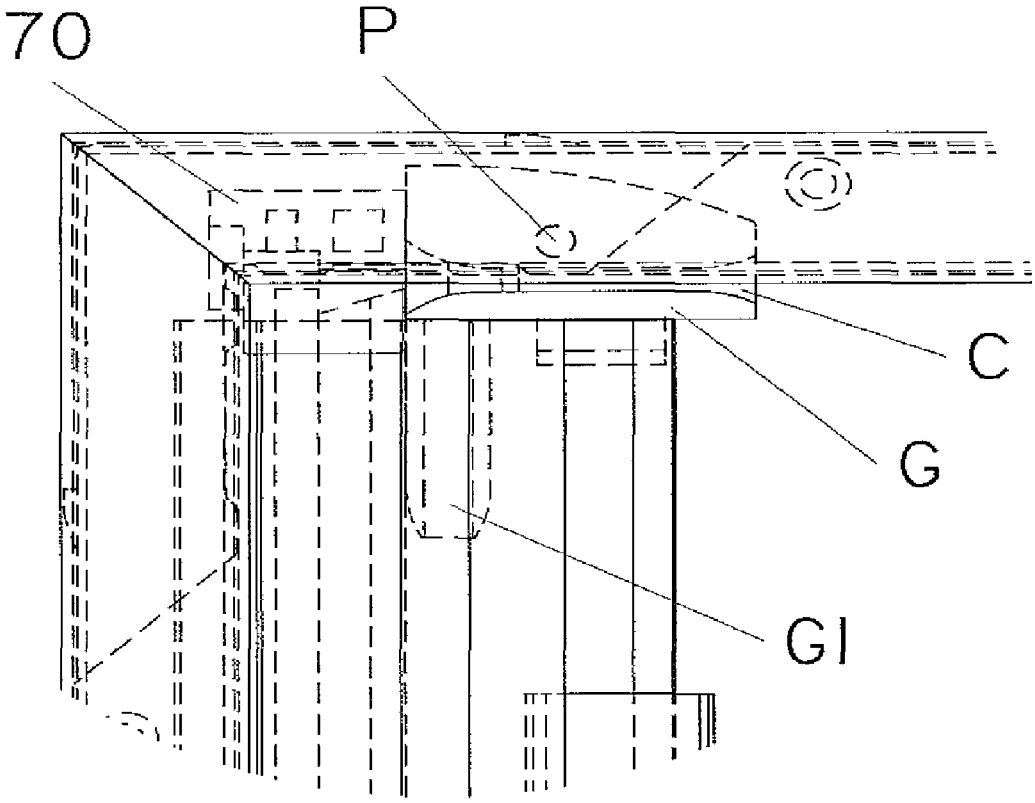
Figure 14B:
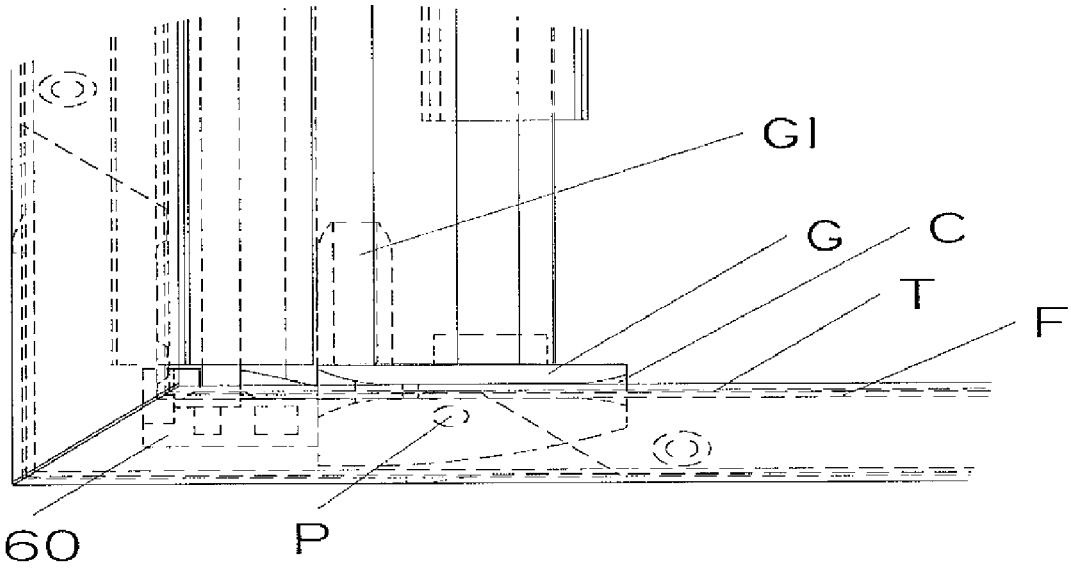

Referring now to FIGS. 14, 14A and 14B there is illustrated an entry door embodiment including all the aspects of the previous invention with exception that there is illustrated herein a guide G for the draw bar of the screen assembly which is best seen in FIG. 14 including a channel C riding between the flange portions F of the track part T. The channel is tapered at each end to provide a manufacturing tolerance for the assembly should the tracks in the header and sill not be parallel to one another at all locations. Said glide G is retained in position at the end of the handle frame by a pin P, which is positioned during assembly in a pin receiving area formed with said glide with said pin P passing through said pin receiving area. The pin G1 therefore as has been previously taught by Preferred Engineering may provide for a telescopic effect to provide for accommodation of these manufacturing tolerances. Otherwise the latch assembly is identical for this embodiment.

Referring now to FIGS. 15, 16 and 17 there is illustrated the alternative embodiment of the latch assembly to be utilized with a window. Since the screen for a window is not normally operated externally there is only need for a cam member 100 having one grip 111 and the cut out providing the camming surfaces for pins 402 as best seen in FIGS. 16 and 17 is generally triangular in shape with the triangle being truncated. There is no need of course for the generally diamond shaped cut out in this window embodiment for the reasons indicated. The pin therefore 402 rides within the cut out 140 to provide for the release action of this alternative latch assembly for a window. A cover portion 600 is provided to seal the cam member 100 from the elements and provide dust protection.

As many changes can be made to the preferred embodiment of the invention without departing from the scope thereof; it is intended that all matter contained herein be considered illustrative of the invention and not in a limiting sense.

The embodiments of the invention for which an exclusive property or privilege is claimed are defined as follows:

1. A latch assembly for a roll out screen having a handle frame disposed at a free end thereof, said latch assembly further comprises an actuator comprising a camming member having two ends and having disposed proximate each end a grip, and having disposed between said grips a substantially diamond shaped opening, defining cam surfaces for engaging pins provided on two operators for operating release bolts, each pin being disposed at one end of each operator and having disposed proximate the other end, release bolt engaging parts, said release bolts also including operator engaging parts for engaging said operators, the release bolts traveling in said handle frame having a hollow therein to carry each operator, said release bolts being engageable with a closure frame of a closure assembly at an end thereof remote said operators; for movement between a latched position and an unlatched position when the camming member is moved in a direction generally perpendicular to the extension of said handle frame; the camming member being held in position by a retainer bushing disposed in a slot in the handle frame, said bushing also including a cut out for receiving the pins of said operators to allow for controlled movement thereof, which in turn provides for the movement of the release bolts to and from the closure frame.

2. A latch assembly for a roll out screen having a handle frame disposed at a free end thereof, said latch assembly further comprising an actuator comprising a camming member extending generally perpendicular to said handle frame and having two ends, having disposed proximate each end a grip accessible by a user to cause motion of the camming member laterally with respect to the handle frame, said camming member having disposed between said grips a substantially diamond shaped opening, defining cam surfaces for engaging pins provided on two operators for operating release bolts of said latch assembly, each pin being disposed at one end of each operator and having disposed proximate the other end of each operator, a rack for engaging the release bolts, said release bolts also including a rack for engaging the racks of said operators, wherein movement of the operators provides movement to the release bolts, as a result of engagement of the racks of said operators with the racks of said release bolts, the release bolts travel in the handle frame at the free end of the roll out screen; said handle frame also having a hollow therein to carry said operators and release bolts and also to retain said camming member; said release bolts being engageable with at least one track of a closure assembly, at the end of said release bolts remote said operators or movement between a latched position wherein the release bolts engages the at least one track and an unlatched position wherein the release bolts disengages the at least one track, wherein the roll out screen can be moved to and from a latched position when the camming member is moved in a direction generally perpendicular to the extension of said handle frame when said grip is accessed, the camming member being held in position by a retainer bushing disposed in a slot in the handle frame, said bushing also including a cut out for receiving the pins of said operators to allow for movement of the operators, which in turn provides for the movement of the release bolts with respect to the at least one track when the grips of the camming member are engaged by a user.

3. The latch assembly of claim 1 wherein each operator engaging part of the release bolts includes a rack for engaging a release bolt engaging part of each operator, wherein the movement of said operators provides movement of the release bolts as a result of this engagement.

4. The latch assembly of claim 3 wherein the release bolt engaging part of the operators includes a rack for engaging the corresponding rack of said release bolts.

5. The latch assembly of claim 1 wherein the handle frame retains the camming member, with two operators, and the release bolts comprising two release bolts.

6. The latch assembly of claim 1 embodied in a roll out screen assembly.

7. The latch assembly of claim 1 or 2 wherein the closure assembly is selected from patio doors, entry doors, windows, and French doors.

8. The latch assembly of claim 7 installed in French doors including two roll out screens with two latch assemblies, one per door of said French doors.

9. The latch assembly of claim 8 wherein the handle frame for each screen for the French doors butts up to one another using compatible edges for opposed handle frames.

10. The latch assembly of claim 8 wherein one of the roll out screens comprises a roll out bug screen extending from a first frame member of the French door and the other roll out screen comprises a roll out blind extending from an opposite second frame member of the French door.

11. The latch assembly of claim 1, wherein the closure frame further comprises two tracks: a header track and a sill track, with header and sill latching portions disposed in each track of the closure frame.

12. The latch assembly of claim 11 wherein the header and sill latching portions further comprise latching blocks installed in the header and sill tracks, said latching blocks having a tapered top terminating in a cutout to receive the release bolts retained from movement with respect to said cutout until the actuator for the latch assembly is operated to retract the-release bolts from said cutout.

13. The latch assembly of claim 2, wherein the at least one track of the closure frame comprises two tracks: a header track and a sill track, with header and sill latching portions disposed in each track of the closure frame.

14. The latch assembly of claim 13, wherein the head and sill latching portions further comprise latching blocks installed in the head and sill tracks, said latching blocks having a tapered top terminating in a cutout to receive the release bolts retained from movement with respect to said cutout until the actuator for the latch assembly is operated to retract the release bolts from said cutout.

15. The latch assembly of claim 8, further comprising two latching blocks positioned back to back proximate the position where two screen handle members butt together to prevent over-extension of the screens.

16. The latch assembly of claim 1 or 2 further comprising springs to bias the operators to engage with the release bolts.

17. A latch assembly for a roll out screen having a handle frame disposed at a free end thereof, said latch assembly, further comprising an actuator therewith comprising a camming member extending generally perpendicular to said handle frame and having two ends, and having disposed proximate each end a grip accessible by a user to cause motion of the camming member laterally with respect to the handle frame, said camming member having disposed between said grips a substantially diamond shaped opening, defining cam surfaces for engaging pins of two operators for operating release bolts of said latch assembly; the pins being disposed at one end of each operator and having disposed proximate the other end of the operator a rack for engaging the release bolts, said release bolts also including a rack for engaging the rack of said operators, wherein movement of the operators provides movement to the release bolts as a result of engagement of the racks of said operators with the racks of said release bolts, the release bolts traveling in the handle frame at the free end of the roll out screen, said handle frame also having a hollow therein to carry said operators and release bolts and also to retain said camming member; said release bolts being engageable with a track of a closure assembly at the end of said release bolts remote said operators, enabling the roll out screen to be moved to and from a latched position, wherein the release bolts engage the track, and an unlatched position wherein the release bolts disengage the track, when the camming member is moved in a direction generally perpendicular to the extension of said handle frame when said grip is accessed; the camming member being held in position by a retainer bushing disposed in a slot in the handle frame, said bushing also including a cut out for receiving the pins of said operators to allow for movement of the operators, which in turn provides for the movement of the release bolts with respect to the track when the grips of the camming member are engaged by a user.

* * * * *